US006319071B1

(12) United States Patent
Sato

(10) Patent No.: US 6,319,071 B1
(45) Date of Patent: Nov. 20, 2001

(54) JOINT CONNECTOR

(75) Inventor: Kei Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/438,769

(22) Filed: Nov. 12, 1999

(30) Foreign Application Priority Data

Nov. 13, 1998 (JP) ..... 10-324091

(51) Int. Cl.[7] ..... H01R 13/502
(52) U.S. Cl. ..... 439/701; 439/928
(58) Field of Search ..... 439/701, 928, 439/717, 879, 924.1, 885, 594, 651, 224, 222

(56) References Cited

U.S. PATENT DOCUMENTS 4,558,919 * 12/1985 Pohl ..... 339/206
4,707,043 * 11/1987 Reed ..... 439/142
5,030,138 7/1991 Capp et al. ..... 439/497

FOREIGN PATENT DOCUMENTS 61-39705 2/1986 (JP) .
01-103168 7/1989 (JP) .
08-064314 3/1996 (JP) .
2000-150055 5/2000 (JP) .

* cited by examiner

*Primary Examiner*—Gary Paumen
*Assistant Examiner*—Alexander Gilman
(74) *Attorney, Agent, or Firm*—Finnegan, Henderson, Farabow, Garrett & Dunner, L.L.P.

(57) ABSTRACT

A joint connector is provided with upper and lower housings and linkage terminals accommodated in the respective housings. Each linkage terminal comprises a plurality of terminals and carriers coupling the terminals. A plugging-in piece of each terminal projects below a bottom portion of each housing. A pair of spring pieces corresponding to the plugging-in piece is provided on each terminal. In the linkage terminal, carriers and plugging-in pieces are cut off according to a circuit configuration required. A connecting state among the terminals in one housing is set by the carriers. A connecting state among the terminals between the upper and lower housings are maintained by the plugging-in pieces. Thereby, a required circuit pattern is set in the upper and lower housings.

12 Claims, 20 Drawing Sheets

JOINT CONNECTOR

BACKGROUND OF THE INVENTION

1. Field of the Invention

The present invention relates to a joint connector.

2. Description of the Related Art

As a conventional joint connector, there has been known a branch connector shown in FIG. 1 and disclosed in Japanese Utility Model Application Laid-Open (JU-A) No. 1-103168. In this branch connector, a plurality of conductors 1 are sandwiched between an upper case 2 and a lower case 3, connectors 5 are accommodated in connector insertion portions 4, and the connectors 5 are fitted in the connector insertion portions 4. The connectors 5 are respectively attached with wires 7, each wire 7 having one end with a U-shaped terminal 6.

When the connector 5 is inserted into the connector insertion portion 4, the terminal 6 of the one end of the wire 7 projects below the connector insertion portion 4 to be connected to a corresponding conductor 1 positioned at a predetermined position and sandwiched between the upper case 2 and the lower case 3.

As the connector 5, there are a rectangular tubular one illustrated in FIG. 1 and tubular ones with an upper large diameter portion and a lower small diameter portion illustrated in FIGS. 2A and 2B. Two connecting plates 6A, 6B integrally formed with a terminal 6 are provided in a connector 5A illustrated in FIG. 2A. Terminals 9A, 9B of conductors 8A, 8B are fitted to the connecting plates 6A, 6B so that branching and/or connecting of a circuit is performed.

A connecting plate 6C integrally formed with the terminal 6 is provided in a connector 5B illustrated in FIG. 2B. A terminal 9C of a conductor 8C is fitted to the connecting plate 6C so that branching and connecting of a circuit are performed.

SUMMARY OF THE INVENTION

However, in the conventional joint connectors (branch connectors), a plurality of housing members such as the upper case 2, the lower case 3, the connectors 5 (5A, 5B) and the like are required and a plural kinds of the terminals 6 must be prepared, which results in increase in the number of parts. Accordingly, manufacturing, management and/or assembling work of these many parts are made complicated, so that it becomes difficult to reduce manufacturing cost.

In view of the above, an object of the present invention is to provide a joint connector at a low cost, which has an excellent productivity and whereby various circuit configurations can be assembled and secure connection can easily be performed.

In order to attain the above object, a joint connector of the present invention comprises upper and lower housings stacked, and conductive terminals respectively connected with wires. The terminals are accommodated in each housing. The terminals in each housing can mutually be connected to one another. Each terminal has a portion to be connected and a connecting portion projecting below the housing. The terminals include an upper terminal in the upper housing and a lower terminal in the lower housing corresponding to the upper terminal. In a state where the housings have been stacked at a predetermined position, the connecting portion of the upper terminal is disposed such that it can be connected to the portion to be connected of the lower terminal.

According to the above structure, as terminals accommodated in each housing are connectable among the terminals, wire connecting and wire branching are allowed in the housing. Also, as a connecting portion of an upper terminal is connectable to a portion to be connected of a lower terminal between upper and lower housings stacked at the predetermined position, wire connecting and wire branching are easily performed between the upper and the lower housings. Furthermore, when terminals having the same structure and housings having the same structure are prepared, the number of configuration parts can be reduced. Accordingly, productivity is improved and manufacturing cost is reduced.

The terminals are formed integrally in a multi-connected manner, and they can be separated according to a circuit configuration required.

According to the above structure, a single terminal and a plurality of terminals mutually connected are provided without connecting work among terminals, which results in reduction in working or manufacturing cost.

The connecting portion may be configured with a connecting plate, and the portion to be connected may be configured with spring pieces sandwiching the connecting portion.

According to the above structure, a connecting plate is inserted between spring pieces of a lower terminal so that upper and lower terminals are easily connected electrically to each other. Accordingly, a pattern of a circuit configuration is expanded.

The housings approach to each other along a stacking direction to reach the predetermined position, so that the connecting portion of the upper terminal may be engaged with the portion to be connected of the lower terminal.

The housings are moved relative to each other along a direction intersecting the stacking direction to reach the predetermined position, so that the connecting portion of the upper terminal may be engaged with the portion to be connected of the lower terminal.

The connecting portions may be cut off according to a circuit configuration required.

According to the above structure, a connecting portion of an upper terminal is cut off so that a circuit configuration where upper and lower terminals are not connected to each other is obtained. Accordingly, a circuit configuration can easily and appropriately be modified.

Each housing may have openings, and the connecting portions in one housing may be caused to pass through the openings of the one housing.

According to the above structure, connecting portions of terminals respectively pass through openings of a housing, so that the connecting portions project below the housing. A connecting portion passes through an opening of a housing, so that an edge of the opening is prevented from movement of a terminal and the terminal is maintained at a proper position in the housing.

Each housing may have protecting walls for protecting the connecting portions passing through the openings respectively formed at peripheral edges of the openings.

According to the above structure, deformation of a connecting portion passing through an opening is prevented by a protecting wall.

The joint connector may have engaging means for holding the housings in the stacked state at the predetermined position.

According to the above structure, as housings are held by engaging means in a stacked state at a predetermined position, a connecting state between upper and lower terminals is securely maintained when the upper and lower terminal are connected to each other.

Each terminal may have a wire holding portion for holding the wire.

According to the above structure, a wire is easily and securely held by a terminal.

DESCRIPTION OF THE PREFERRED EMBODIMENTS

Figure 1:
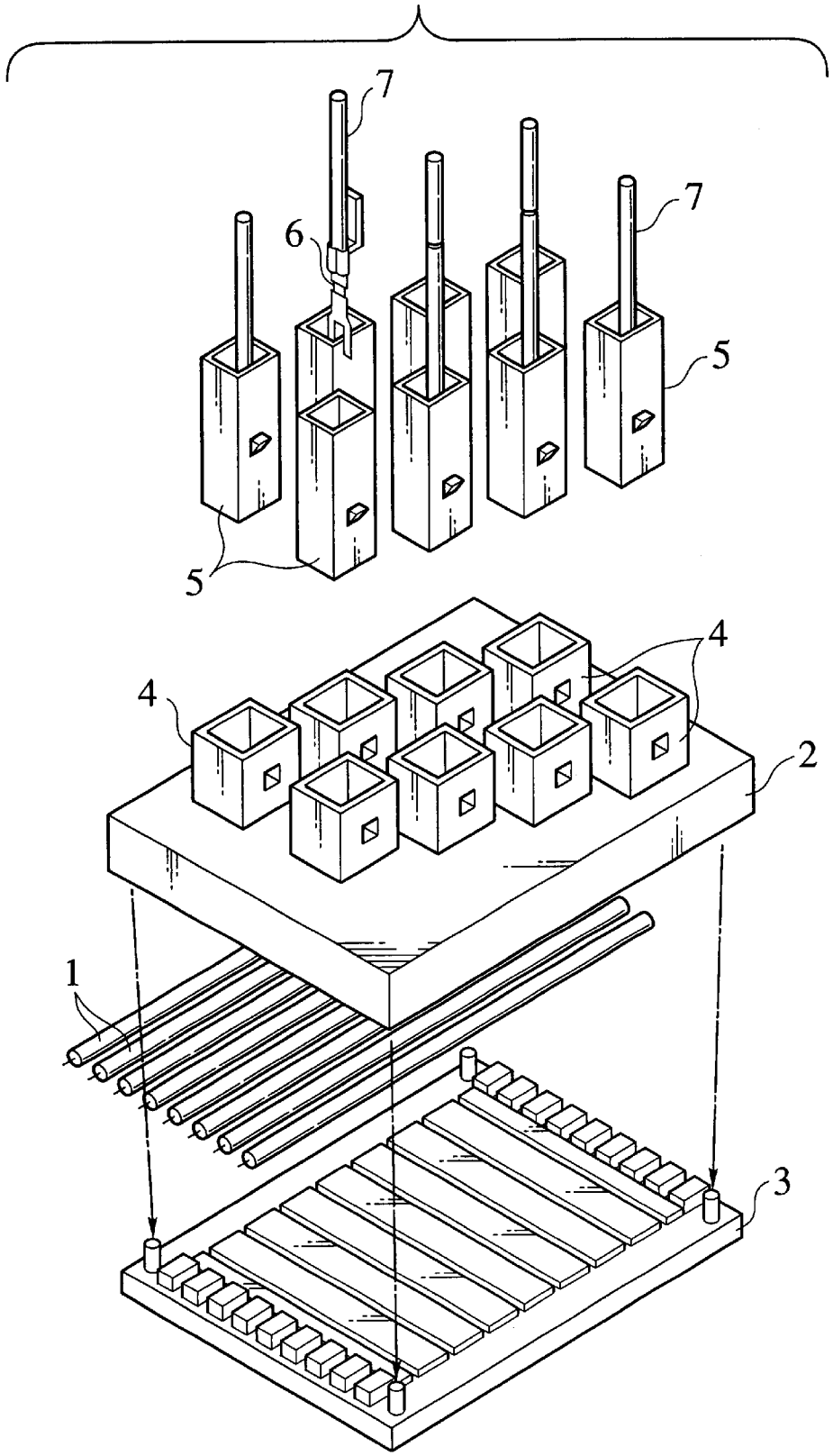
FIG.1 PRIOR ART
FIG. 1 is an exploded perspective view illustrating a conventional joint connector (branch connector)
Figure 2A:
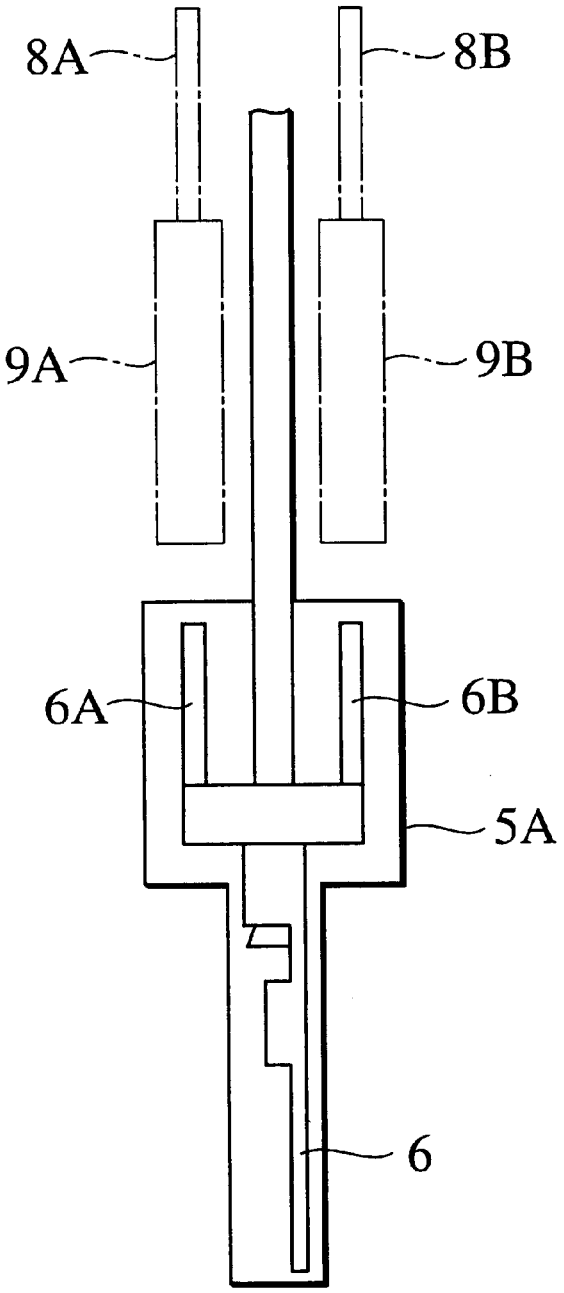
FIG.2A PRIOR ART
FIG. 2A is a sectional view illustrating a conventional joint connector.
Figure 2B:
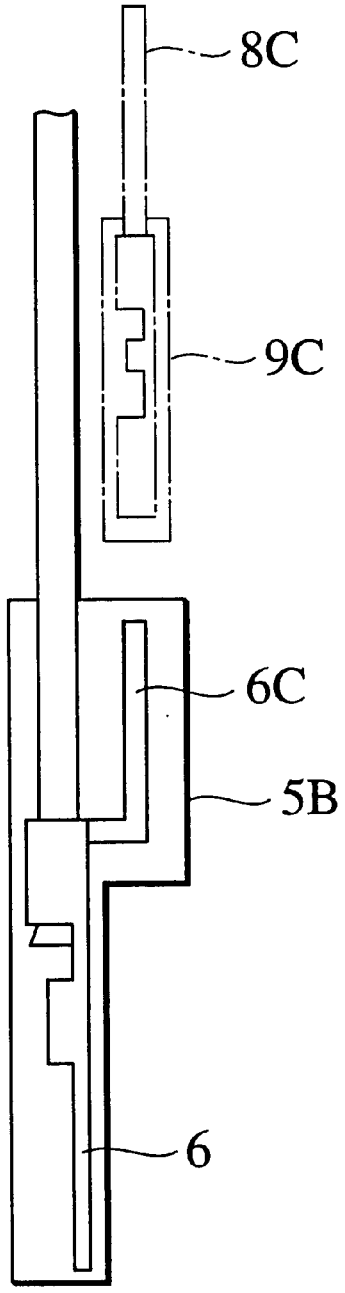
FIG.2B PRIOR ART
FIG. 2B is a sectional view illustrating another conventional connector.

A joint connector according to the present invention will be explained in detail with reference to respective embodiment illustrated in the drawings below.

First Embodiment

Figure 3:
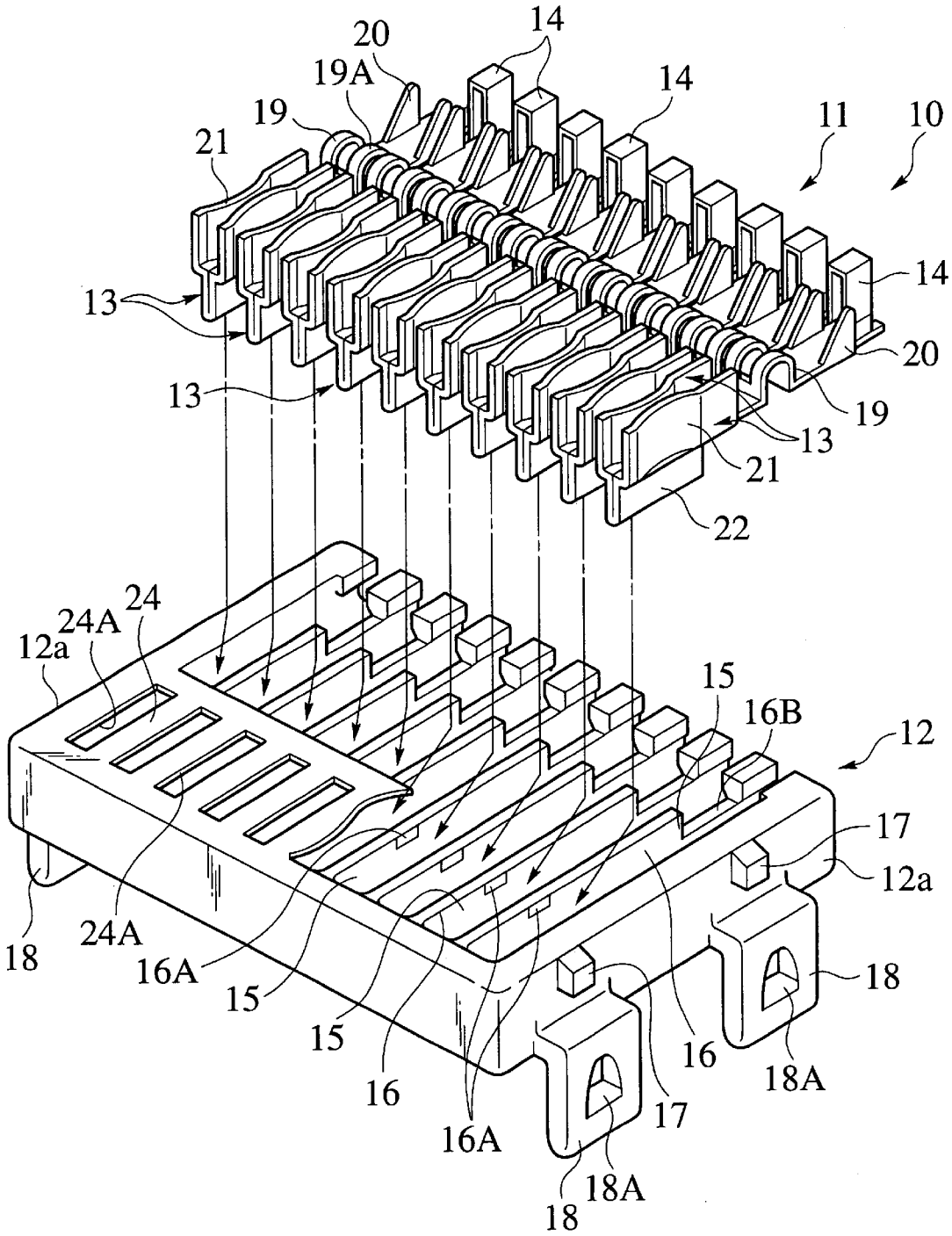
FIG. 3 is an exploded perspective view illustrating a module in a first embodiment of a joint connector according to the present invention.

FIG. 3 is a perspective view illustrating a housing 12 and a linkage terminal 11 before accommodated in the housing 12. The housing 12 and the linkage terminal constitute a module 10 of a joint connector according to a first embodiment of the present invention.

The linkage terminal 11 is provided by working processing a metal plate. The linkage terminal 11 comprises a plurality of terminals 13 arranged in parallel and carriers (coupling portions) 14 coupling adjacent terminals 13. The terminals 13 are connected to one another in a multi-continuous manner through the carriers 14.

The housing 12 made of insulating resin material is formed in a generally rectangular shape. The housing 12 is partitioned by partition walls 16 such that accommodation grooves 15 arranged in parallel are formed in the housing 12. Each accommodation groove 15 corresponds to each terminal 13 belonging to one linkage terminal 11.

Engaging protrusions 16A for preventing the terminals 13 accommodated from coming off are respectively formed at predetermined positions on the partition walls 16. Two protrusions 17 for module engagement are formed side by side on an upper portion of each of outside faces 12*a* of the housing 12.

Locking pieces 18, 18 for engagement extending from the outside face 12*a* downwardly are formed below the protrusions 17 for module engagement. An opening 18A in which a protrusion 17 for module engagement of another housing 12 is fitted is formed in each locking piece 18 for engagement.

Figure 4:
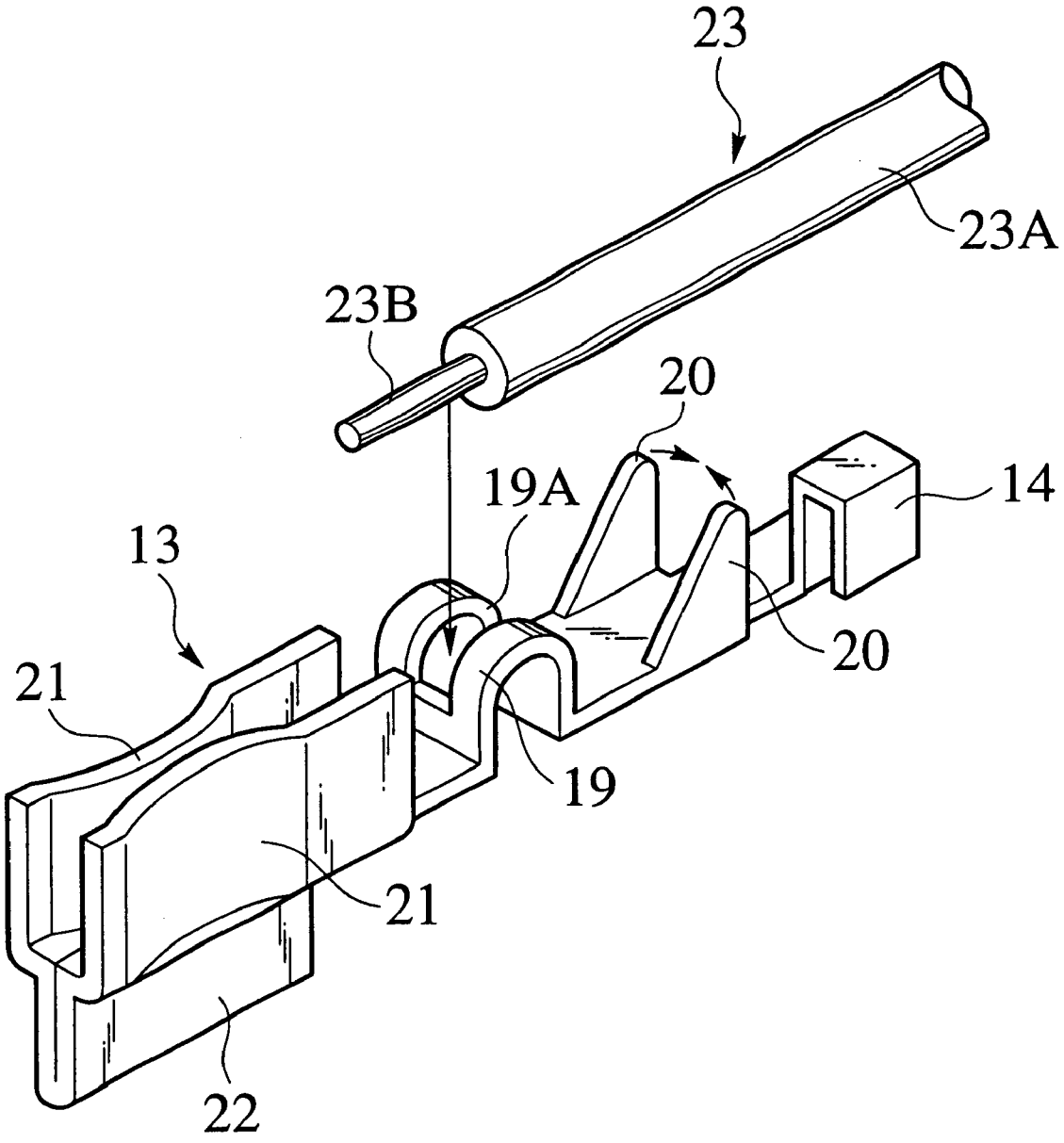
FIG. 4 is a perspective view explaining how to connect a wire to a terminal in the first embodiment.

Prior to explanation of a structure of the housing 12, a structure of the terminal 13 constituting the linkage terminal 11 will be explained herein with reference to FIG. 4. Incidentally, the terminal 13 illustrated in FIG. 4 is illustrated in a state where it has been cut off from adjacent terminals 13 by cutting the carriers 14.

An upwardly bent conductive wire press-fitting portion 19 is formed on an intermediate portion, in a longitudinal direction, of the terminal 13 by bending work or processing. A slit 19A is formed in a central portion of the conductive wire press-fitting portion 19 so as to extend along the longitudinal direction of the terminal 13. Bending pieces 20 are formed in a standing manner from both side portions of the terminal 13 positioned between the conductive wire press-fitting portion 19 and the carrier 14.

A pair of connecting spring pieces (resilient plates) 21, 21 serving as a portion to be connected are disposed nearer to a distal end side than the conductive wire press-fitting portion 19. The spring pieces 21, 21 are erected from both side portions of the terminal 13 to be opposed to each other. A plugging-in piece (connecting plate) 22 for connection serving as a connecting portion projects downwardly from a bottom portion positioned between the spring pieces 21, 21.

When the plugging-in piece 22 is plugged in between spring pieces 21 of another terminal 13, two terminals 13 are electrically connected to each other.

As illustrated in FIG. 4, when a wire 23 is connected to the terminal 13, an insulating cover 23 at a distal end of the wire 23 is first removed to expose a conductive wire 23B. Next, the conductive wire 23B is press-fitted into the slit 19A to be connected to the conductive wire press-fitting portion 19. Simultaneously, a portion of the wire 23 covered with an insulating cover is put between the bending pieces 20, and the bending pieces 20 are bent in directions indicated by arrows in FIG. 4 so that the wire 23 is fixed in the terminal 13.

Figure 5:
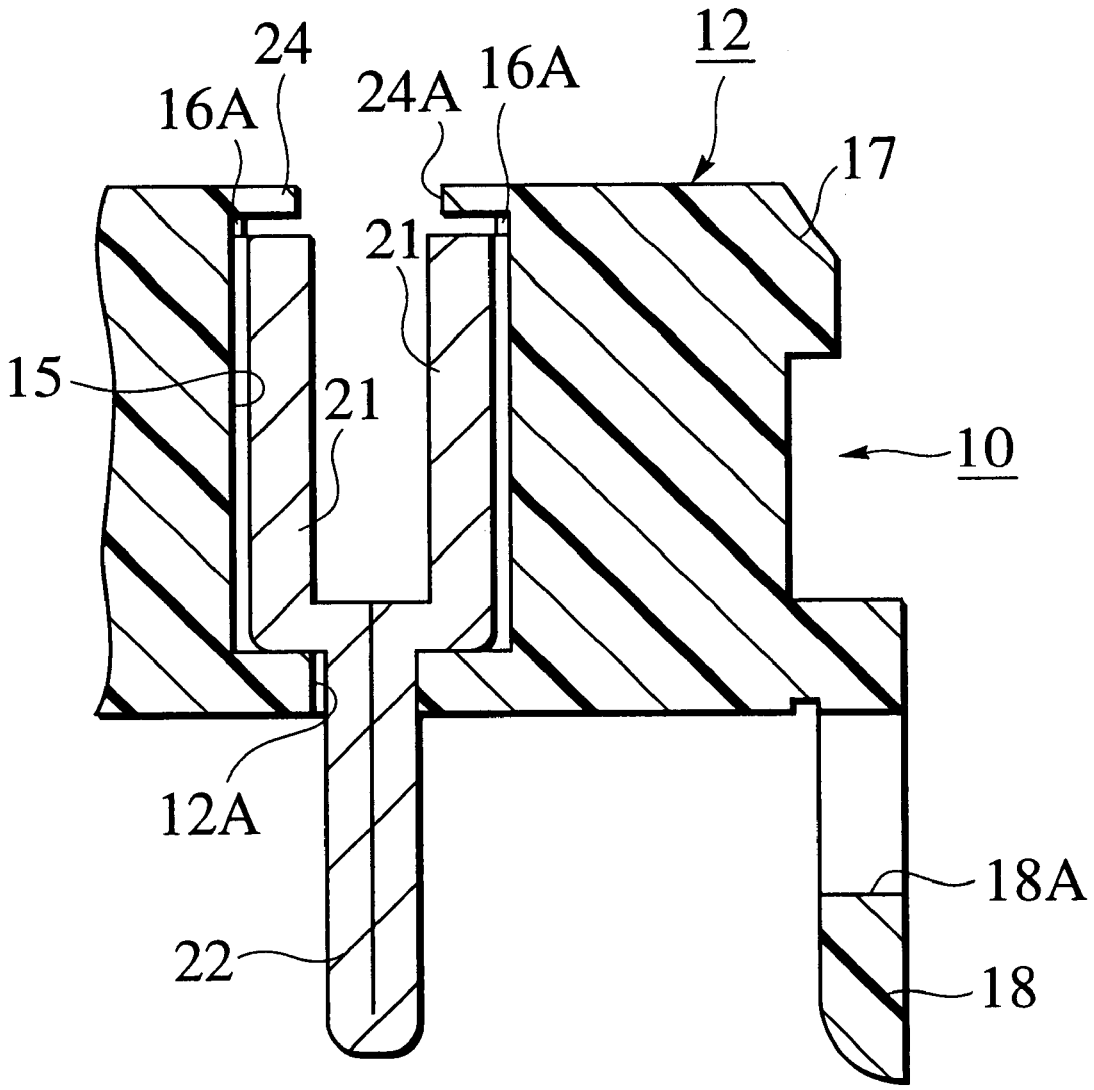
FIG. 5 is a sectional view of a main portion illustrating a state where a terminal is fitted in a housing in the first embodiment.

As illustrated in FIG. 5, slits 12A serving as openings are formed in the housing 12 for accommodating the linkage terminal 11 comprising the terminals 13 connected in a multi-continuous manner. The slits 12A are formed in bottom portions of the respective accommodation grooves 15. The plugging-in piece 22 of each terminal 13 passes through each slit 12A. The plugging-in piece 22 which has passed through the slit 12A projects downward from a lower face of the housing 12.

The terminal 13 is restricted from being moved along its longitudinal direction relative to the housing 12 by insertion of the plugging-in piece 22 in the slit 12A.

Incidentally, at this time, an upper end portion of each spring piece 21 is engaged with an engaging protrusion 16A formed on the partition wall 16. Accordingly, the terminal 13 is prevented from coming off from the accommodation groove 15.

A cover portion 24 which is positioned at upper portions of portions of the accommodation grooves 15 accommodating the spring pieces 21 and which has insertion holes 24A in which plugging-in pieces 22 of other terminals 13 can be inserted is formed in the housing 12.

As illustrated in FIG. 3, a notch 16B having a width size slightly longer than that of the carrier 14 is formed at each partition wall 15 between adjacent accommodation grooves 15, 15. The carrier 14 is engaged with the notch 16B. The terminal 13 is restricted from being moved along its longitudinal direction relative to the housing 12 by engagement of the carrier 14 with the notch 16B.

Figure 6:
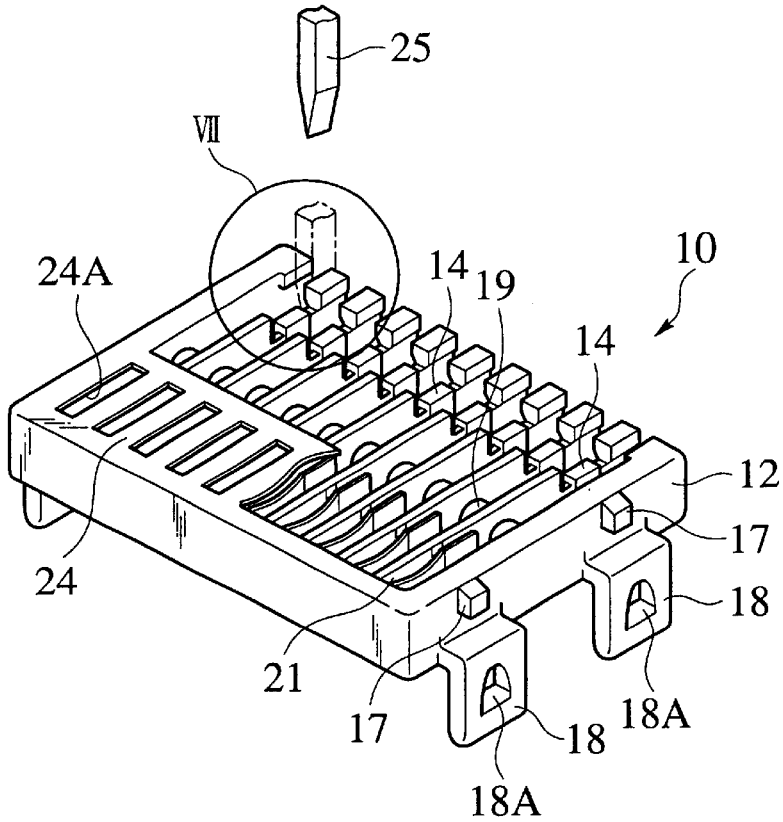
FIG. 6 is a perspective view illustrating how to separate linkage terminals attached to the housing into respective terminals in the first embodiment.
Figure 7:
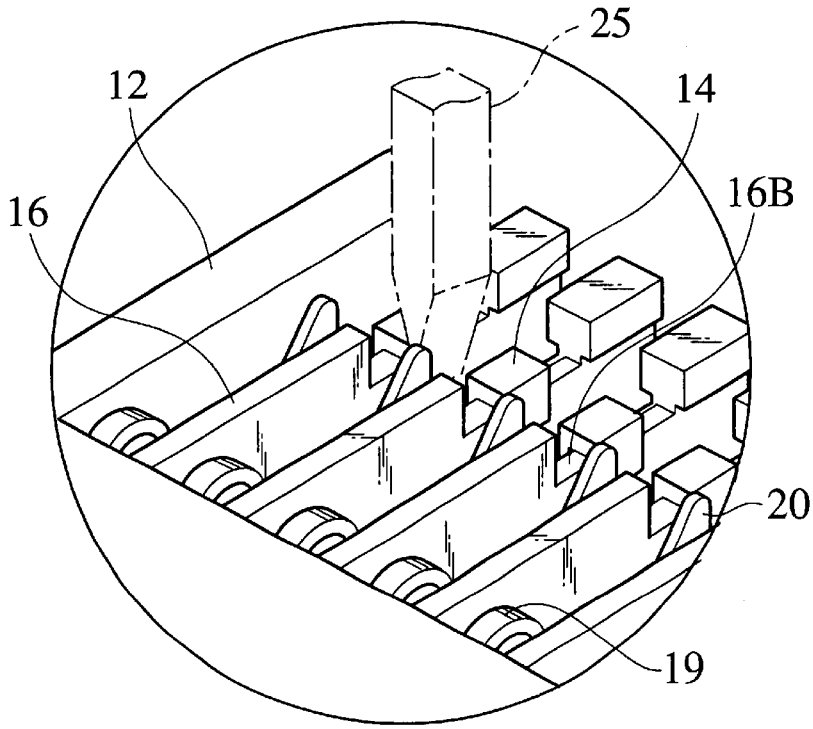
FIG. 7 is an enlarged perspective view illustrating a portion VII surrounded by a circle in FIG. 6.

As illustrated in FIGS. 6 and 7, in order to separate the linkage terminal 12 into individual terminals 13 according to a connection circuit configuration required, after the linkage terminal 11 is accommodated in the housing 12, it is pressed and cut into the terminals 13 with a carrier cutting jig 25.

Figure 8:
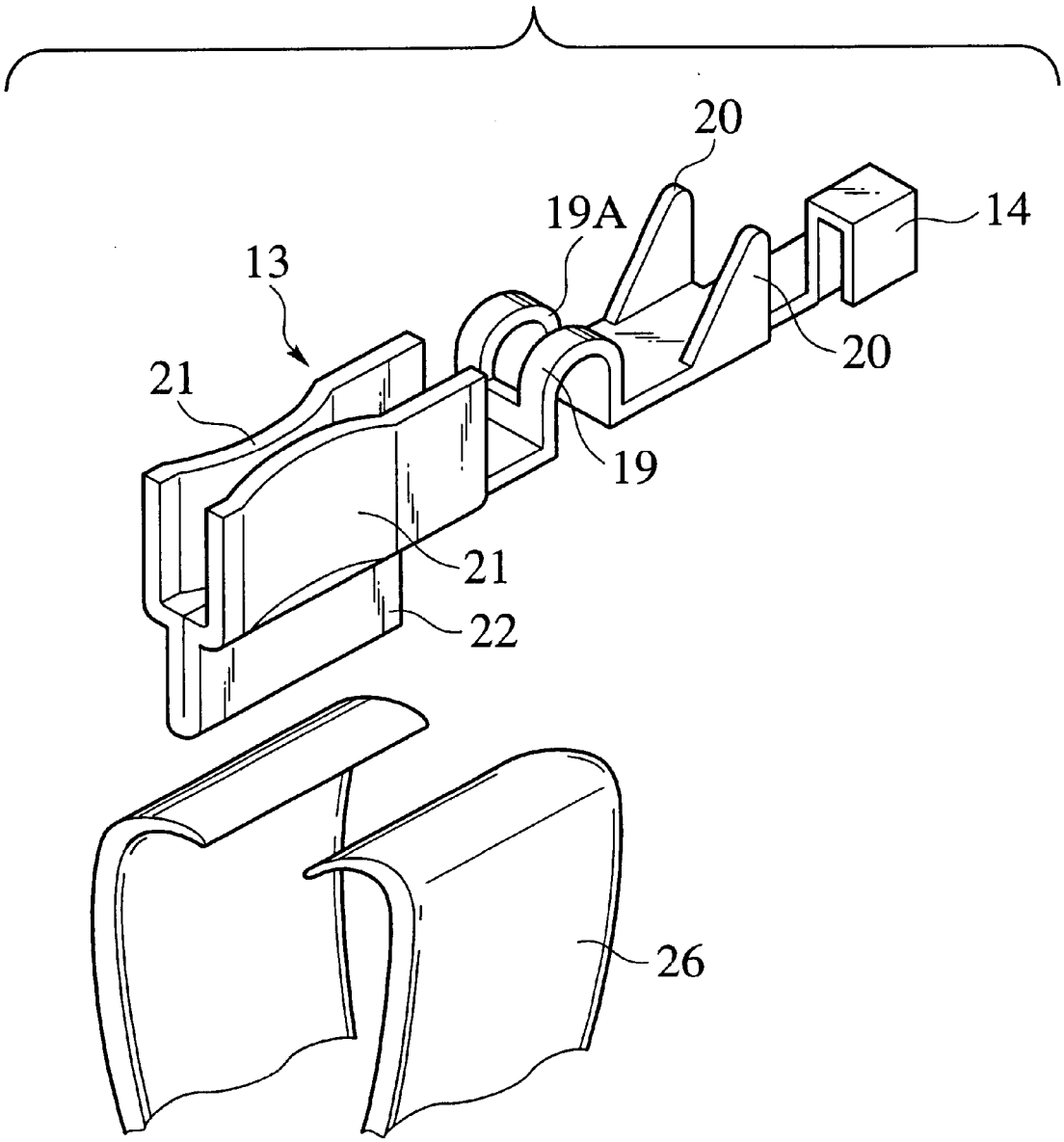
FIG. 8 is a perspective view illustrating how to cut an insertion piece for connection of a terminal in the first embodiment.

As described later, when the modules 10 each having the housing 12 accommodating a plurality of the terminals 13 are stacked and a connection between the upper and lower modules is performed, and connection between the terminals 13 belonging to the upper and lower modules 10 and positioned so as to correspond to each other is not required, the plugging-in piece 22 of the terminal 13 belonging to the upper module 10 is cut and removed by a plugging-in piece cutting jig 26 as illustrated in FIG. 8.

Figure 9:
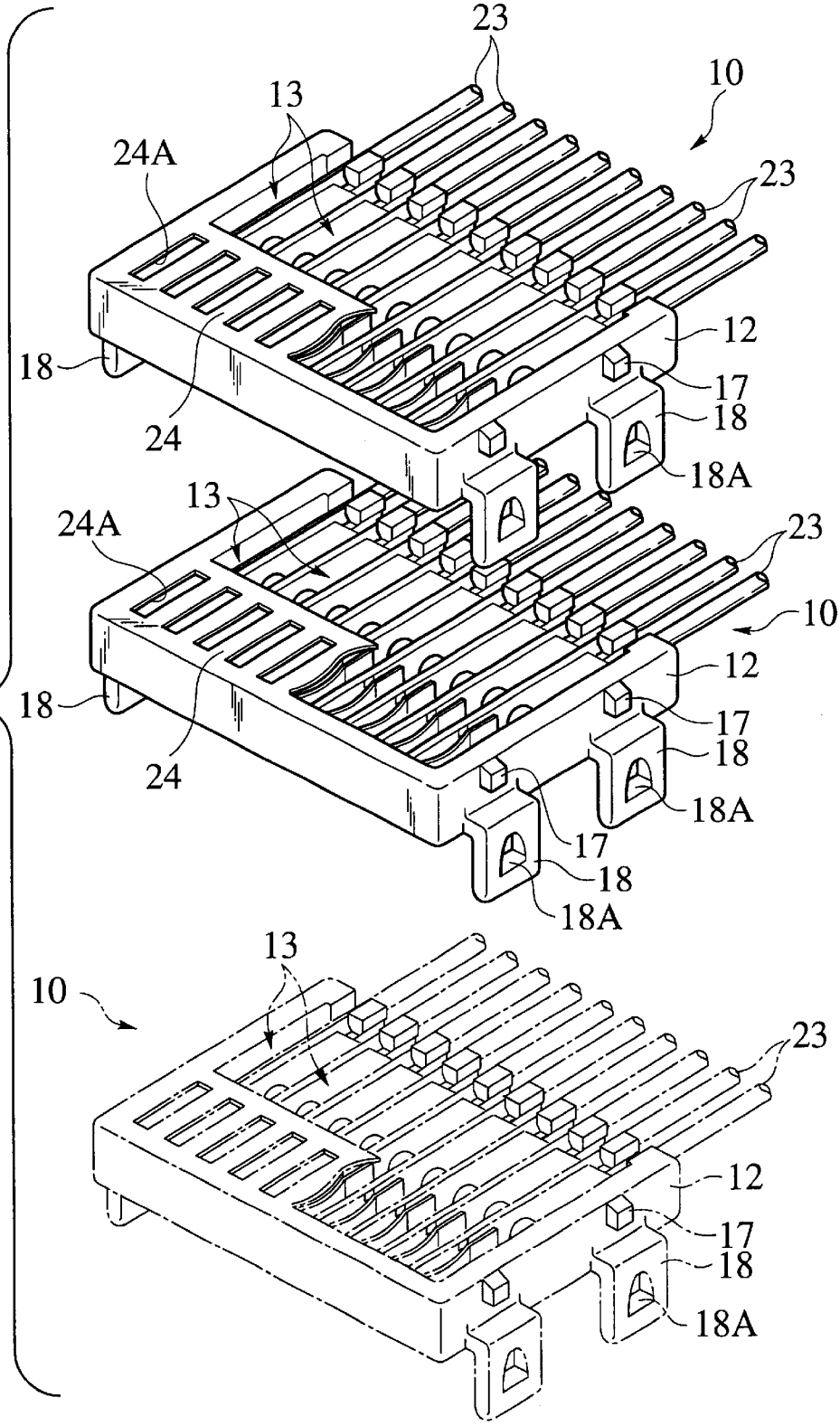
FIG. 9 is a perspective view illustrating a case that the modules in the first embodiment are stacked in three stages.
Figure 10:
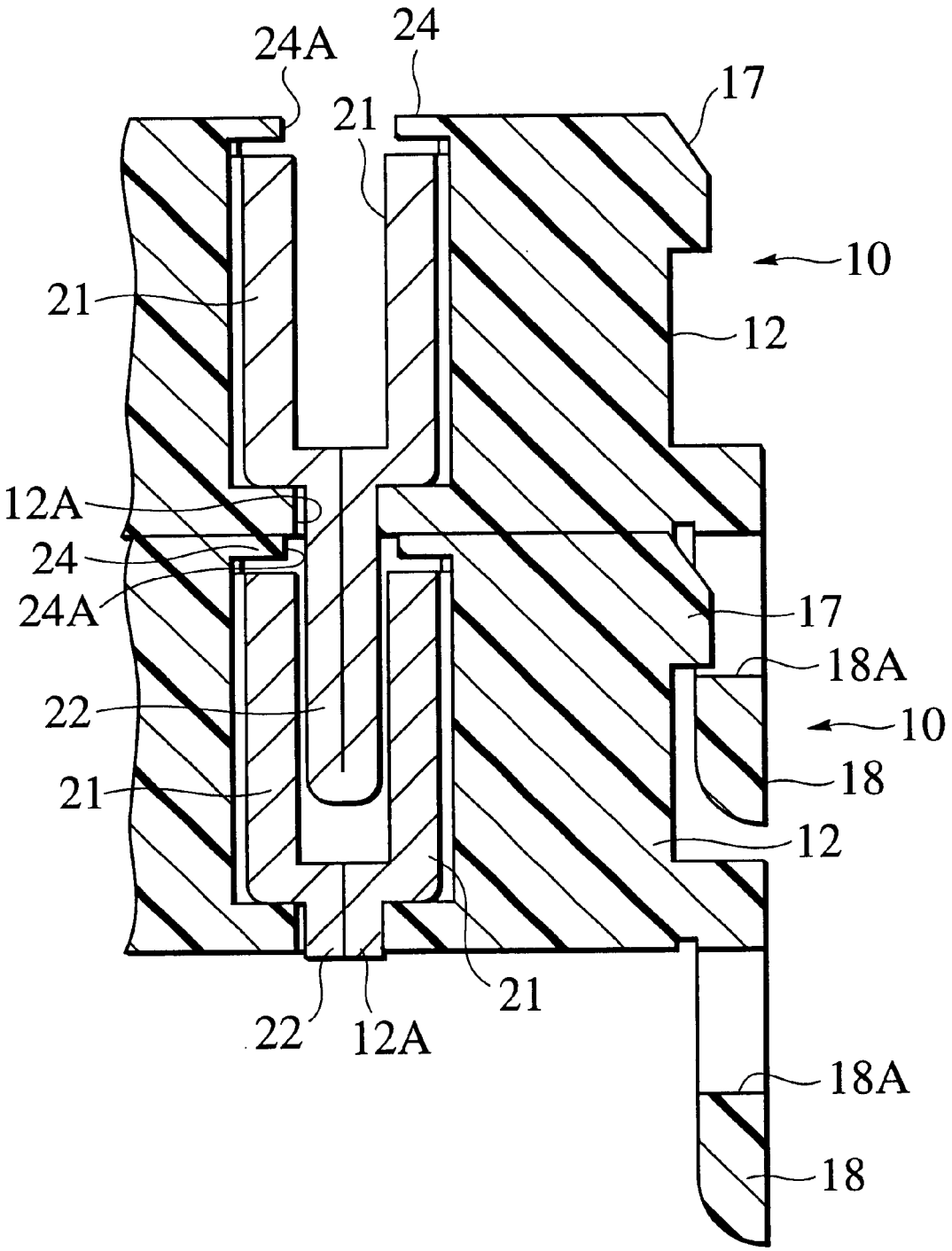
FIG. 10 is a sectional view illustrating a state where the modules in the first embodiment have been stacked in two stages.

As illustrated in FIG. 9, in order to stack the modules 10 vertically, each module 10 including the housing 12 accommodating a plurality of the terminals 13, a plurality of modules 10 are stacked one on another in a state where the wire 23 is connected to each terminal 13 in each housing 12. As illustrated in FIG. 10, the protrusions 17 for module engagement of the housing positioned below, or the lower housing, are fitted into the openings 18A of the locking pieces 18 for engagement of the housing 12 positioned above, or the upper housing 12. Thereby, the upper and lower modules 10 are locked to each other in a stacked state.

At this time, the plugging-in piece 22 of one of the terminals 13 in the upper housing 12, which is required to be electrically connected to a corresponding terminal 13 in the lower housing 12 is plugged in between the spring pieces 21, 21 of the corresponding terminal 13 in the lower housing 12. Thereby, a desired pair of the terminals 13 of a plurality of pairs of the opposed terminals 13 in the upper and lower housings 12 are electrically connected to each other.

Figure 11:
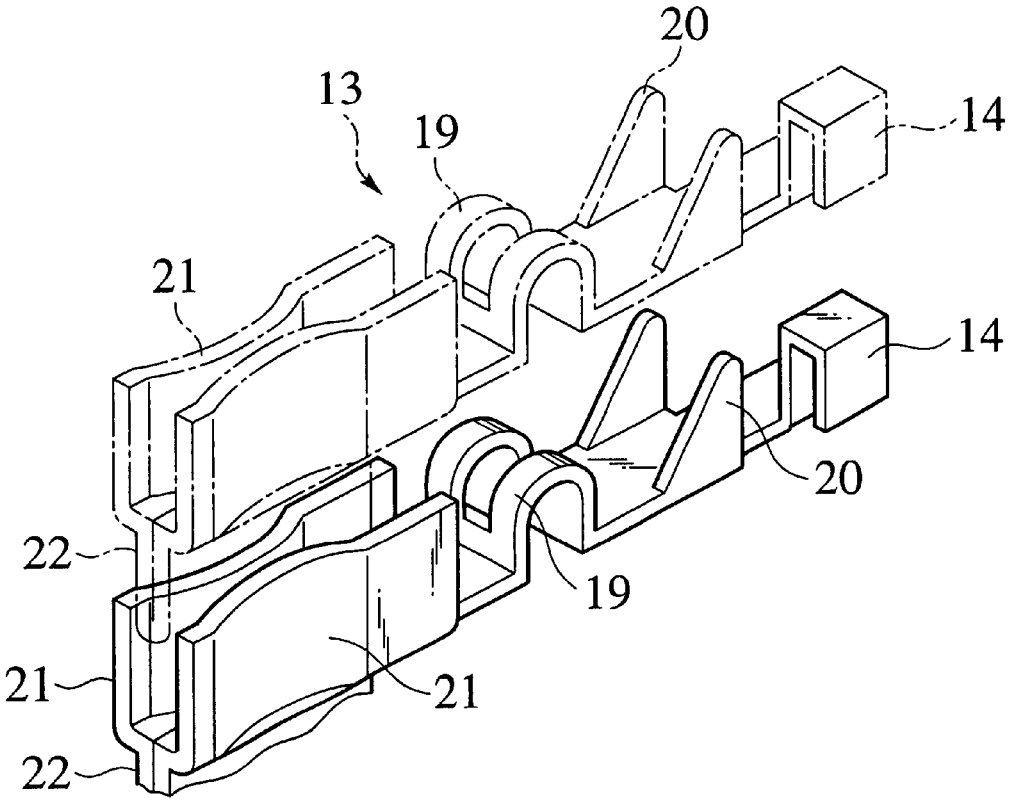
FIG. 11 is a perspective view illustrating a state where the modules in the first embodiment are connected to each other above and below.

Incidentally, FIG. 10 illustrates a state where the plugging-in piece 22 of the terminal 13 in the lower housing 12 has been cut off by the plugging-in piece cutting jig 26. Also, FIG. 11 is a perspective view illustrating a state where the upper and lower terminals 13, 13 illustrated in FIG. 10 have been connected to each other.

Figure 12:
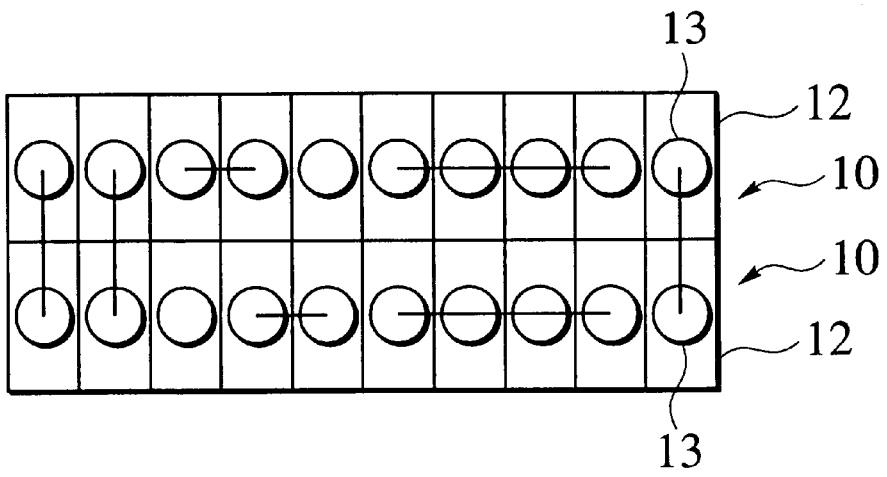
FIG. 12 is an explanative view illustrating a wire configuration example using the module in the first embodiment.

In the above, the structure of the module 10 of the joint connector of the first embodiment has been explained. By using such a module 10, for example, a connection structure illustrated in FIG. 12 can be obtained. In FIG. 12, the housings 12 and the terminals 13 are shown in an illustration manner.

In FIG. 12, a portion where the terminals 13 are connected to each other by a horizontal line shows a state where the carrier(s) 14 of the terminals 13 arranged horizontally has not cut off, while a portion where the terminals 13 are not connected to each other by a horizontal line shows a state where the carrier(s) 14 has been cut off.

Also, in FIG. 12, a portion where the terminals 13 are connected to each other by a vertical line shows a state where the plugging-in piece 22 of the upper terminal 13 has been plugged in between the spring pieces 21, 21 of the lower terminal 13. A portion where the terminals 13 are not connected to each other by a vertical line shows a state where the plugging-in piece 22 of the upper terminal 13 has been cut off.

Thus, cutting of the carrier(s) 14 and/or cutting-off of the plugging-in piece(s) 22 of the terminals 13 is performed and the required number of the modules 10 are stacked according to a circuit configuration required, so that wire connecting and/or wire branching can be set as required.

Second Embodiment

FIGS. 13 to 19 illustrate a second embodiment of the joint connector according to the invention.

Figure 13:
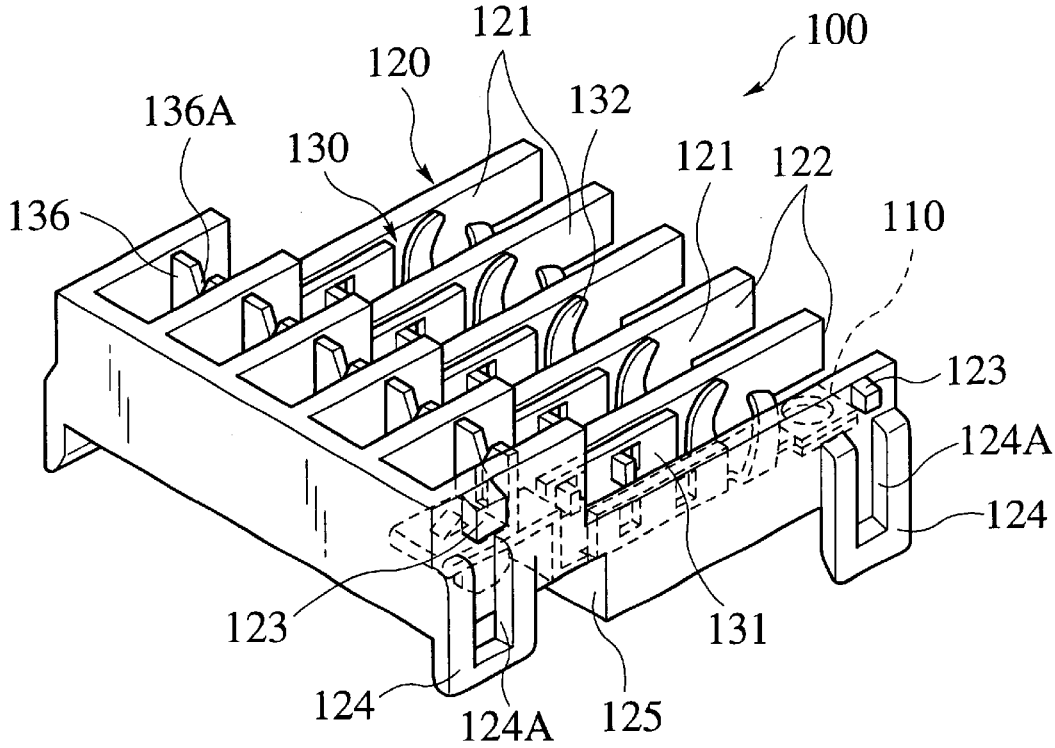
FIG. 13 is a perspective view illustrating a module of a second embodiment of a joint connector according to the invention.

FIG. 13 illustrates a module 100 of the joint connector of this embodiment. The module 100 comprises a linkage terminal 110 and a housing 120 accommodating the linkage terminal 110.

Figure 14:
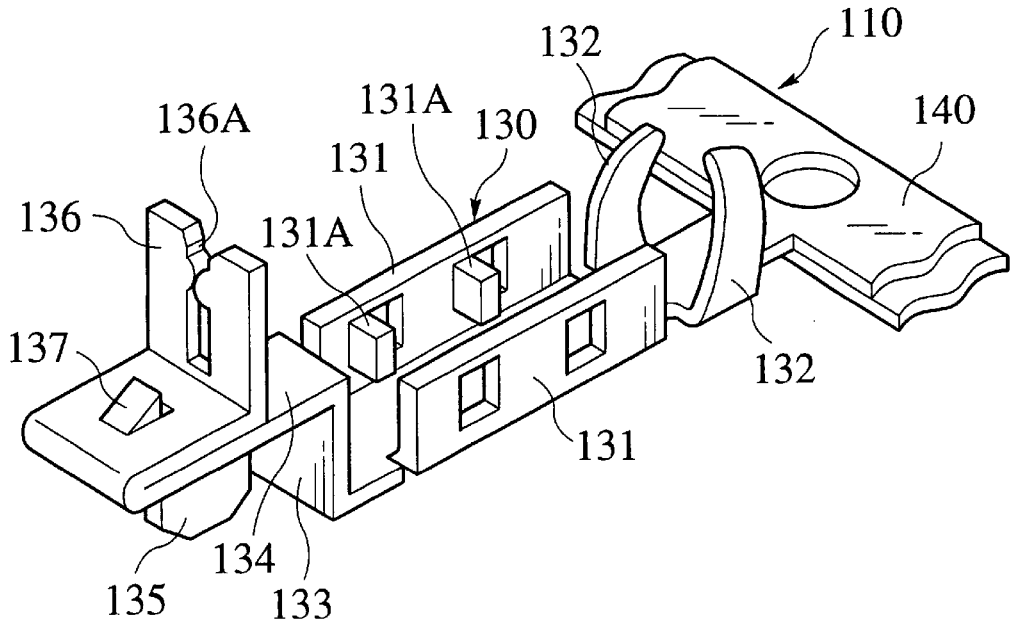
FIG. 14 is a perspective view illustrating a linkage terminal of the second embodiment.

As illustrated in FIG. 14, the linkage terminal 110 is provided by working a metal plate. The linkage terminal 110 comprises a plurality of terminals 130 arranged in parallel and carriers 140 connecting the terminals 130. The terminals 130 are connected via the carriers 140 in a multi-continuous manner.

Formed in the housing 120 made of resin material are accommodation grooves 121 partitioned by partition walls 122 and arranged in parallel. The respective accommodation grooves 121 correspond to the respective terminals 130 belonging to one linkage terminal 110, each terminal 130 has a wire holding portion holding a wire.

Two protrusions 123 for module engagement are formed at an upper portion of each of a pair of outside faces of the housing 120 opposed to each other. Locking pieces 124, 124 for engagement extend downwardly from portions of the outside face positioned below the protrusions 123 for module engagement. An opening 124A into which a protrusion 123 for module engagement of another housing 120 is formed in each engaging lock piece 124.

Next, the structure of the terminal 130 constituting the linkage terminal 110 will be explained with reference to FIG. 14. A pair of wire press-fitting plates 131, 131 erected from both side portions of the terminal 130 are formed on an intermediate portion, in a longitudinal direction, of the terminal 130. Wire press-contacting pieces 131A, 131A are erected in a cutting manner on each wire press-fitting plate 131. Bending pieces 132 erected from both side portions of the terminal 130 are formed at an intermediate portion between the wire press-fitting plates 131 and the carrier 140.

A standing piece 133 along a standing wall 125 of the housing 120 is disposed nearer to a distal end side than the wire press-fitting plates 131. A horizontal plate portion 134 extending forward is formed at an upper portion of the standing piece 133. A plugging-in piece 135 for connection bend downwardly and serving as a connecting portion is formed on the horizontal plate portion 134. A piece 136 to be connected which is bent upwardly to be erected by a predetermined distance and which serves as a portion to be connected is formed on the horizontal plate portion 134.

A slit 136A is formed in the piece 136 to be connected. The plugging-in piece 135 can be plugged in the slit 136A. A protrusion 137 for engagement extending obliquely upward and rearward is disposed in front of the piece 136 to be connected.

Incidentally, the plugging-in piece 135 for connection is plugged in a slit 136A of a piece 136 to be connected of another terminal 130 so that it is electrically connected to the another terminal 130.

Figure 17:
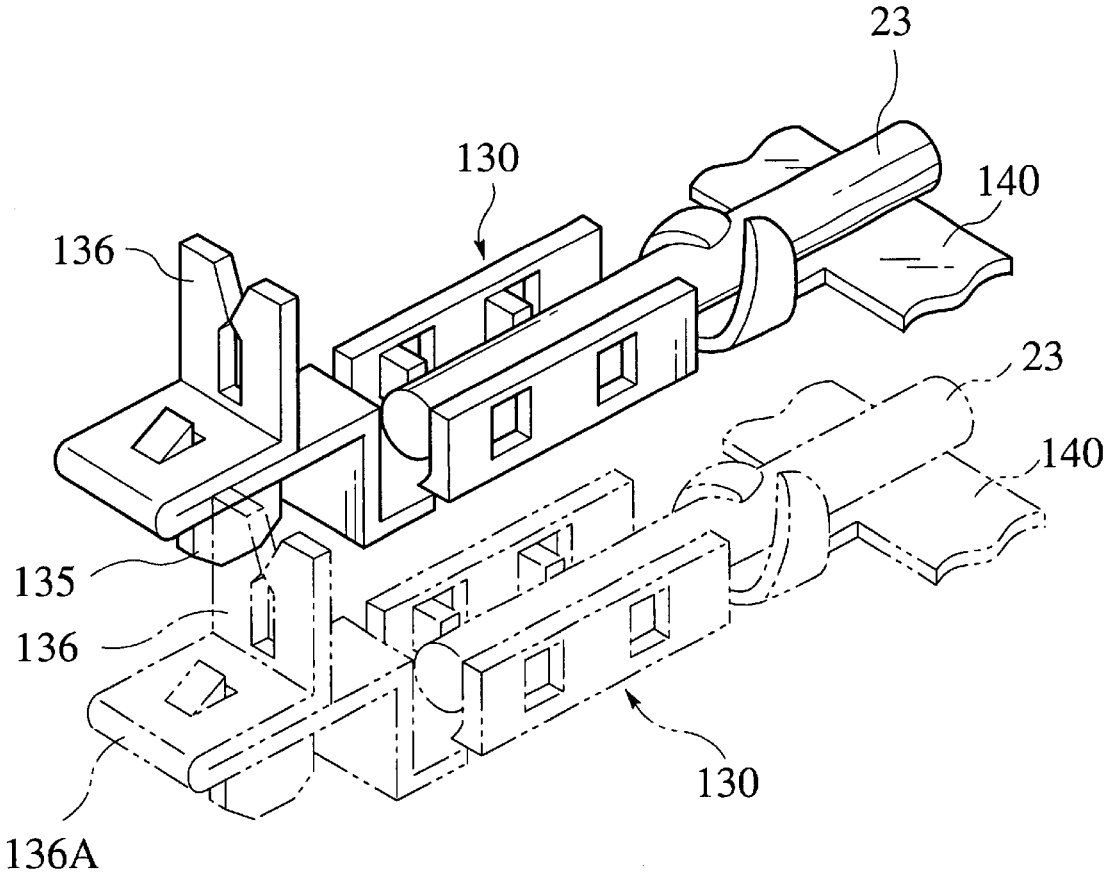
FIG. 17 is a perspective view illustrating connecting units in the second embodiment are connected to each other.

As illustrated in FIG. 17, in order to connect a wire to the terminal 130, a conductive wire (not shown) is press-fitted between the wire press-fitting plates 131, 131 to be connected to the wire press-contacting pieces 131A. Then, a portion of the wire 23 which is covered with an insulating cover is disposed between the bending pieces 132 and the wire 23 is fixed to the terminal 130 by bending the bending pieces 132.

Slits (not shown) serving as openings are formed in the housing 120 accommodating the linkage terminal 110 comprising the terminals 130 connected in a multi-continuous manner. The plugging-in piece 135 of each terminal 130 passes through each slit. The plugging-in piece 135 which has passed through the slit projects downward from a lower face of the housing 120.

Figure 15:
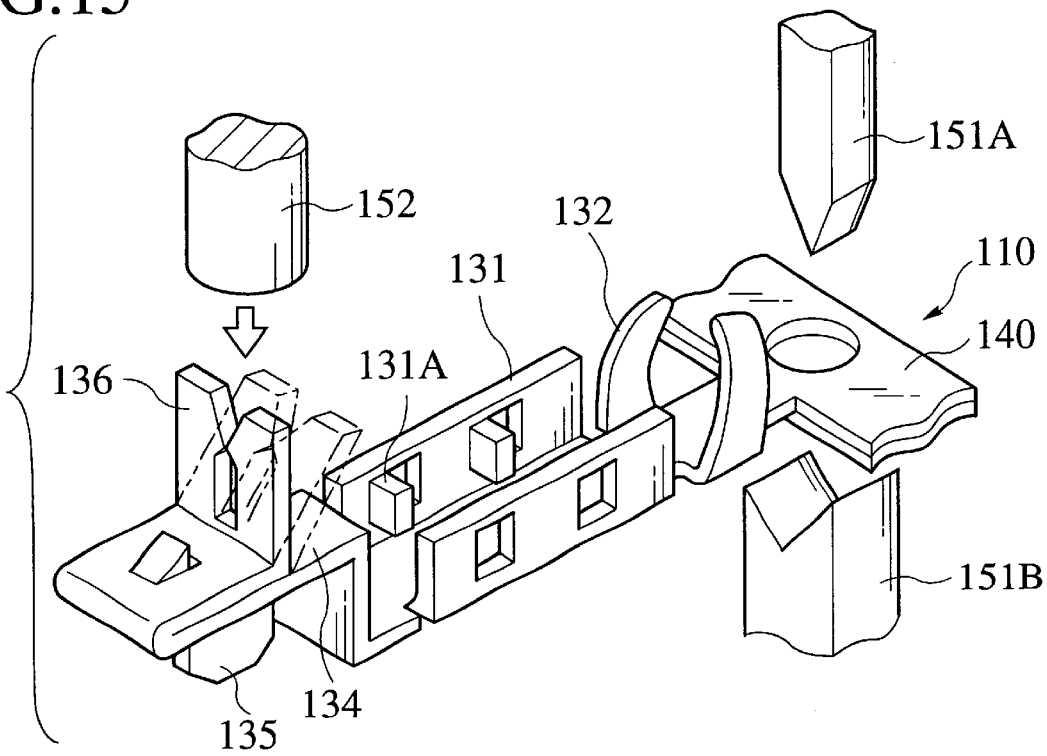
FIG. 15 is a perspective view illustrating how to work the linkage terminal of the second embodiment performed by a jig.

As illustrated in FIG. 15, in order to separate the multi-continuous linkage terminal 110 into individual terminals 130 according to a connection circuit configuration required, after the linkage terminal 110 is accommodated in the housing 120, carrier cutting jig 151A and 151B are pushed on the carrier 140 and the carrier 140 is cut off by the jigs 151A and 151B.

When the modules 100 each having the housing 120 accommodating a plurality of the terminals 130 are stacked and a connection between the upper and lower modules is performed, and there is one of pairs of corresponding upper and lower terminals 130, 130 where connection between the corresponding upper and lower terminals 130 are not required, the piece 136 to be connected of the lower terminal 130 of the pair of the corresponding upper and lower terminals 130 whose connection is not required is fallen down by using such a bending jig 152, as illustrated in FIG. 15.

Figure 16:
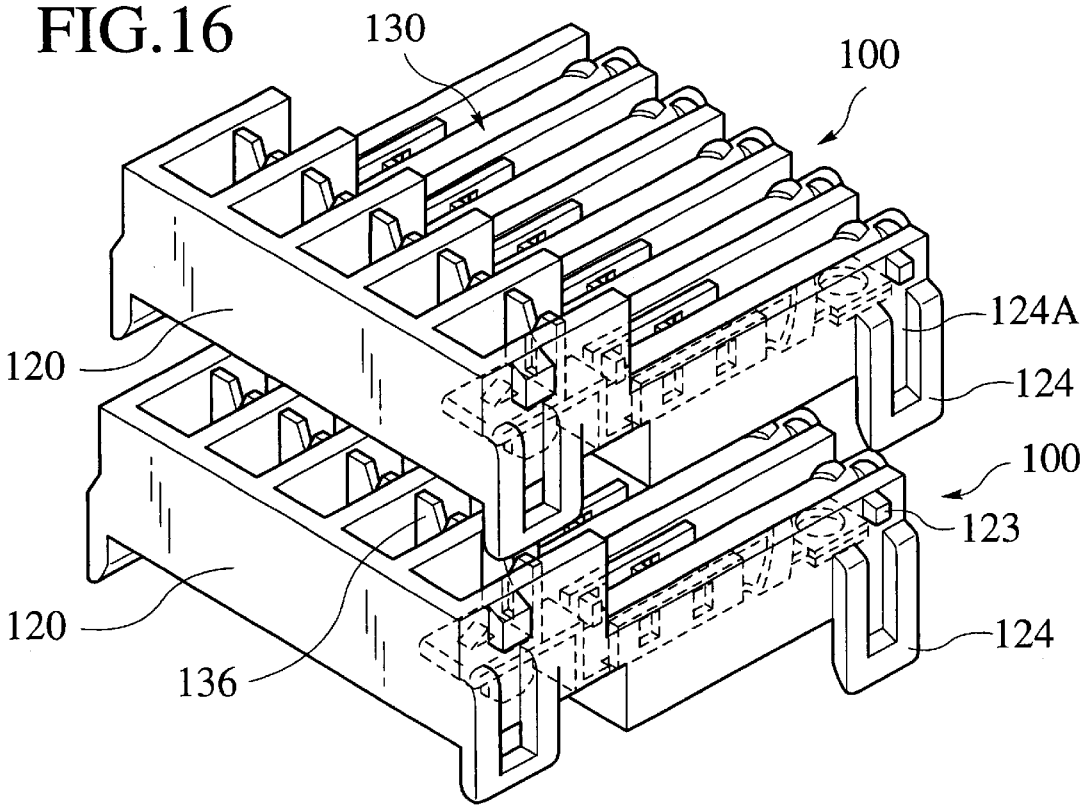
FIG. 16 is a perspective view illustrating a state where modules in the second embodiment are connected to each other.

As illustrated in FIG. 16, in order to stack the modules 100 vertically, each module 100 having the housing 120 accommodating a plurality of the terminals 130, a plurality of the modules 100 are stacked one on another in a state where a wire has been connected to each terminal 130 in each housing 120. Then, the protrusions 123 for module engagement of the lower housing 120 are fitted into the openings 124A of the locking pieces 124 for engagement of the upper housing 120. Thereby, the upper and lower modules 100 are locked to each other in a stacked state.

At this time, as illustrated in FIG. 17, the plugging-in piece 135 of the terminal 130 of the terminals in the upper housing 120 which is required to be electrically connected to a corresponding terminal 130 in the lower housing 120 is plugged in the slit 136A of the piece 136 to be connected of the corresponding terminal 130 in the lower housing 120 so that corresponding terminals 130 in the upper and lower housings 120 are electrically connected to each other.

Figure 18:
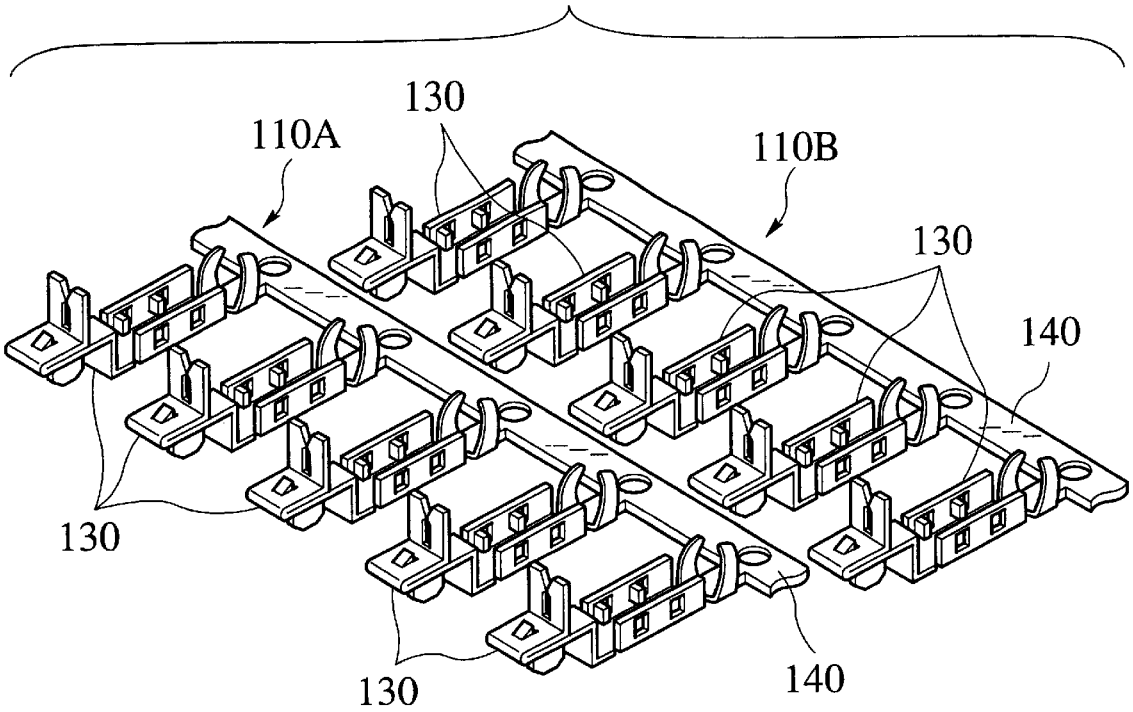
FIG. 18 is a perspective view illustrating the linkage terminals in the second embodiment.
Figure 19:
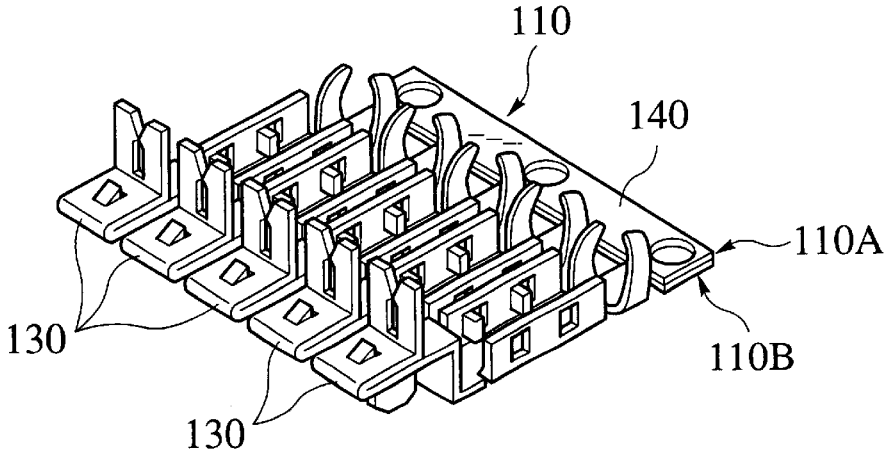
FIG. 19 is a perspective view illustrating the linkage terminals in the second embodiment.
Figure 20:
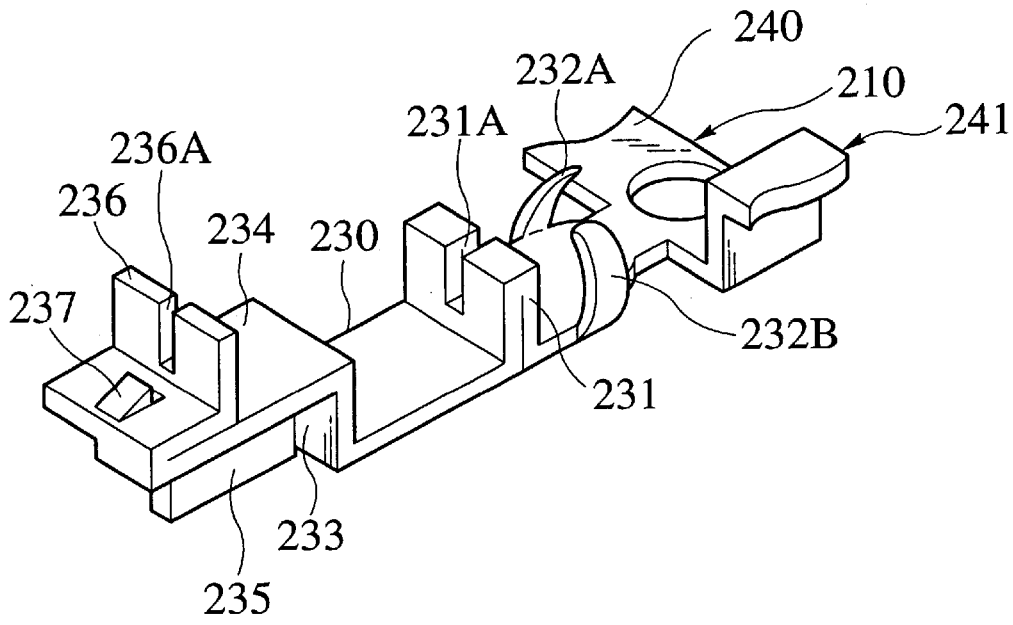
FIG. 20 is a perspective view illustrating a terminal of a third embodiment of a joint connector of the invention.

Incidentally, the linkage terminal 110 used in this embodiment is constituted by combining two linkage terminals 110A, 110B as illustrated in FIG. 18 in such a manner as illustrated in FIG. 19. That is, the carriers 140 are stacked and welded to each other in a state where the terminals 130 of the linkage terminal 110A and the terminals 130 of the linkage terminals 110B have been arranged in a staggered manner. The carriers 140 of the linkage terminal 110 can properly be cut according to the housing 120 used.

In the above, the explanation has been given of the second embodiment. In this embodiment, the carrier(s) 140 of the terminals 130 is cut and/or the piece(s) 136 to be connected is fallen down, and the required number of the modules 100 are stacked so that wire connecting and/or wire branching can be set as required.

Also, the terminal 130 of the present embodiment can be formed by bending an elongated metal plate extending in front and rear directions at proper portions along its front and rear directions, so that a member for the terminal 130 is not required to spread in its widthwise direction and the metal plate which is a mother plate can be effectively utilized, which results in improvement in yield.

Third Embodiment

FIGS. 20 to 23 illustrates a third embodiment of the joint connector according to the invention.

Terminals 230 used in the joint connector of the present invention are formed in parallel on a linkage terminal 210. A conductive wire press-fitting portion 231 bent upwardly in an overlapping manner and having a slit 231A at a central portion is formed in an intermediate portion, in a longitudinal direction (front and rear directions), of each terminal 230 by bending work. Bending pieces 232A, 232B erected at both side portions of the terminal are disposed in an intermediate portion between the conductive wire press-fitting portion 231 and a carrier 240.

A horizontal plate portion 234 extending forward via a standing plate portion 233 is formed nearer to a distal end side than the conductive wire press-fitting portion 231. A plugging-in piece 235 for connection bend downward and serving as a connecting portion is formed on the horizontal plate portion 234. A piece 236 to be connected which is folded back from a front end and erected and which serves as a portion to be connected is formed on the horizontal plate portion 234.

A slit 236A extending from an upper portion of the piece 236 to be connected towards a lower portion thereof is formed at a central portion of the piece 236 to be connected. An engaging projecting piece 237 projects from a portion ahead of the piece 236 to be connected obliquely rearward and upward. Incidentally, a generally U-shaped bent portion 241 is formed on each carrier 240 so as to ride over a partition wall 221 of a housing 220 described later.

Figure 22:
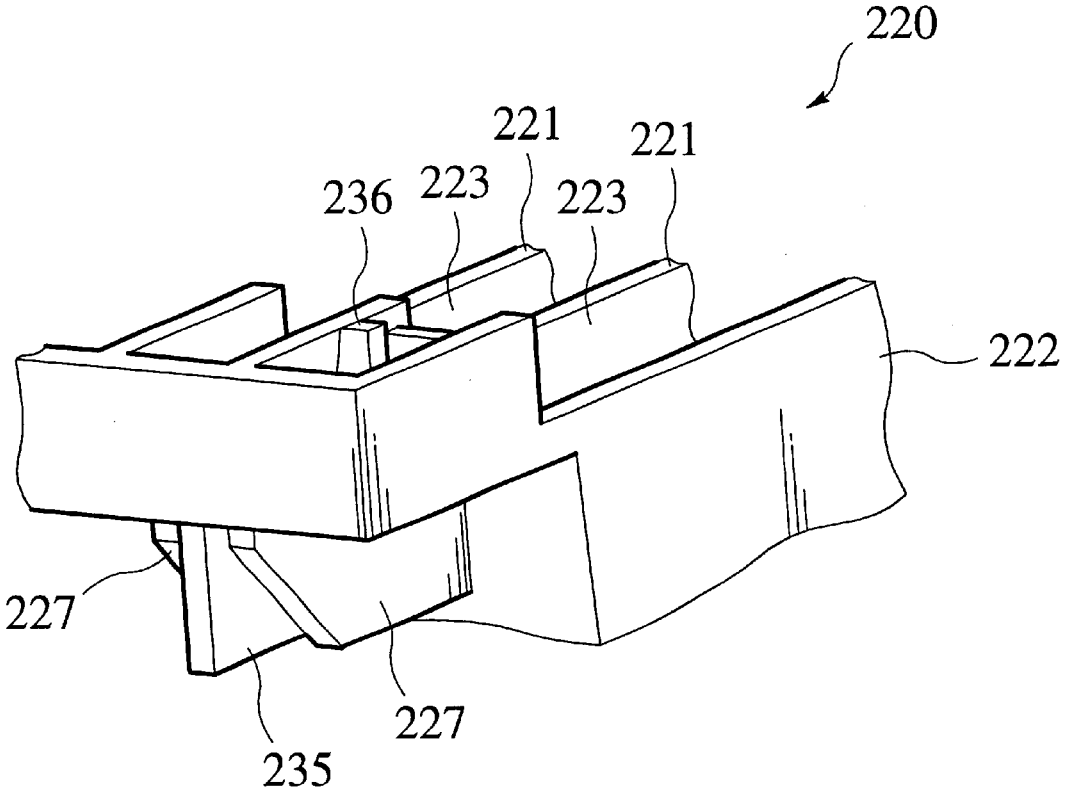
FIG. 22 is a perspective view illustrating a state where a housing and a terminal have been assembled to each other in the third embodiment.

As illustrated in FIG. 22, the housing 220 includes a plurality of accommodation grooves 223 partitioned by a plurality of the partition walls 221 and side walls 222. Each terminal 230 is inserted in each accommodation groove 223. At front ends of the respective accommodation grooves 223, standing walls 224 and horizontal walls 225 are formed so as to correspond to the standing plate portions 233 and the horizontal plate portions 234 of the respective terminals 230.

Figure 21:
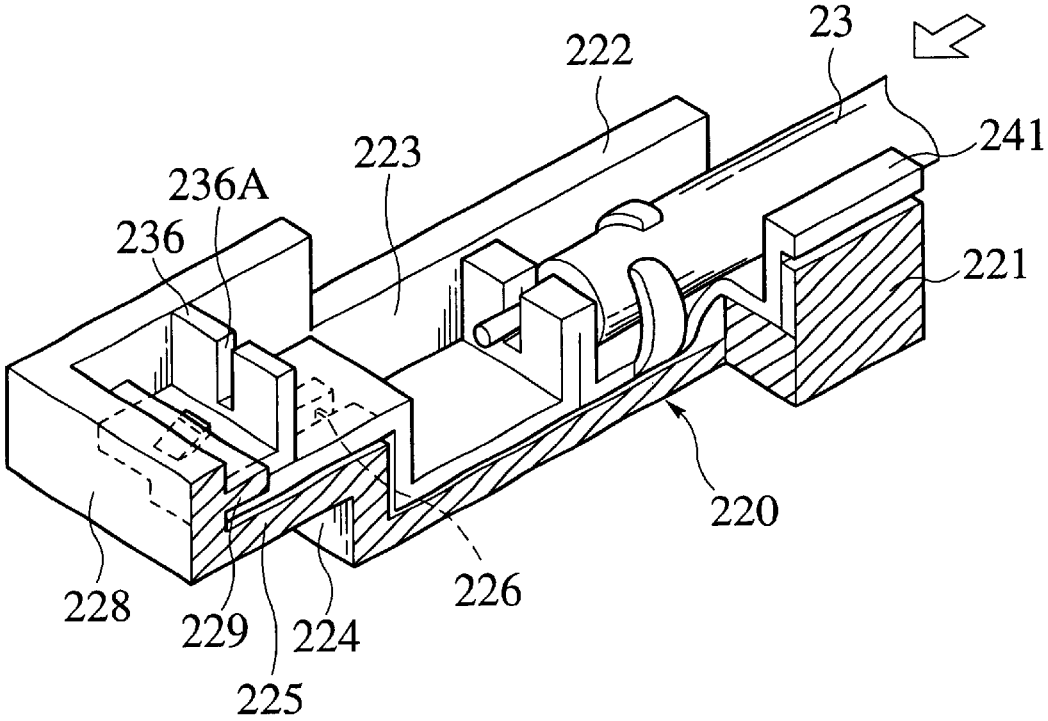
FIG. 21 is a partially sectioned perspective view illustrating the third embodiment.

A slit 226 in which the plugging-in piece 235 is inserted when the terminal 230 is inserted into the accommodation groove 223 from a direction indicated by arrow shown in FIG. 21 is formed in the standing wall 224 and the horizontal wall 225. The plugging-in piece 235 which has been inserted into the slit 226 is exposed below the front end of the housing 220, as illustrated in FIG. 22.

Protection walls 227 are formed on both sides of the slit 224 so as to extend below the lower end of the plugging-in piece 235 which has been inserted in the slit 224. A front end lower portion of each protection wall 227 is formed in a tapered shape such that the protection wall 227 does not prevent a front end lower portion of the plugging-in piece 235 from being connected to another terminal 230. Furthermore, a front end of the horizontal wall 225 constitutes a front side wall 228. An engaging wall 229 having a hole engaged with the engaging protrusion piece 237 of the terminal 230 is formed inside the front side wall 228.

Figure 23:
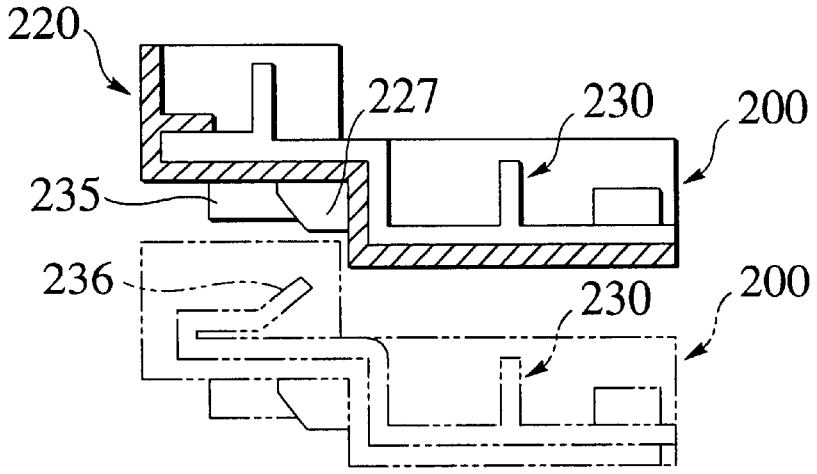
FIG. 23 is an explanative view illustrating how to assemble upper and lower modules in the third embodiment.

The terminals 230 of the linkage terminal 210 is mounted in the housing 220 so that the module 220 serving as the joint connector of the present embodiment is constituted. As illustrated in FIG. 23, the modules 200 are stacked on each other in a state where the piece 236 to be connected of one of the terminals 230 in the lower housing 220 which is not required to be electrically connected to corresponding one of the terminals 230 in the upper housing 220 has been fallen down. Thereby, the piece 236 to be connected which has been fallen down is pressed by the protection walls 227 of the upper housing 220. Accordingly, the connecting plugging-in piece 235 of the upper terminal 230 and the piece 236 to be connected which has been fallen down are prevented from coming in contact with each other.

Also, as the plugging-in piece 235 is protected by the protection walls 227, the plugging-in piece 235 is prevented from deforming.

Fourth Embodiment

FIGS. 24 to 28 illustrate a fourth embodiment of the joint connector according to the present invention.

Figure 24:
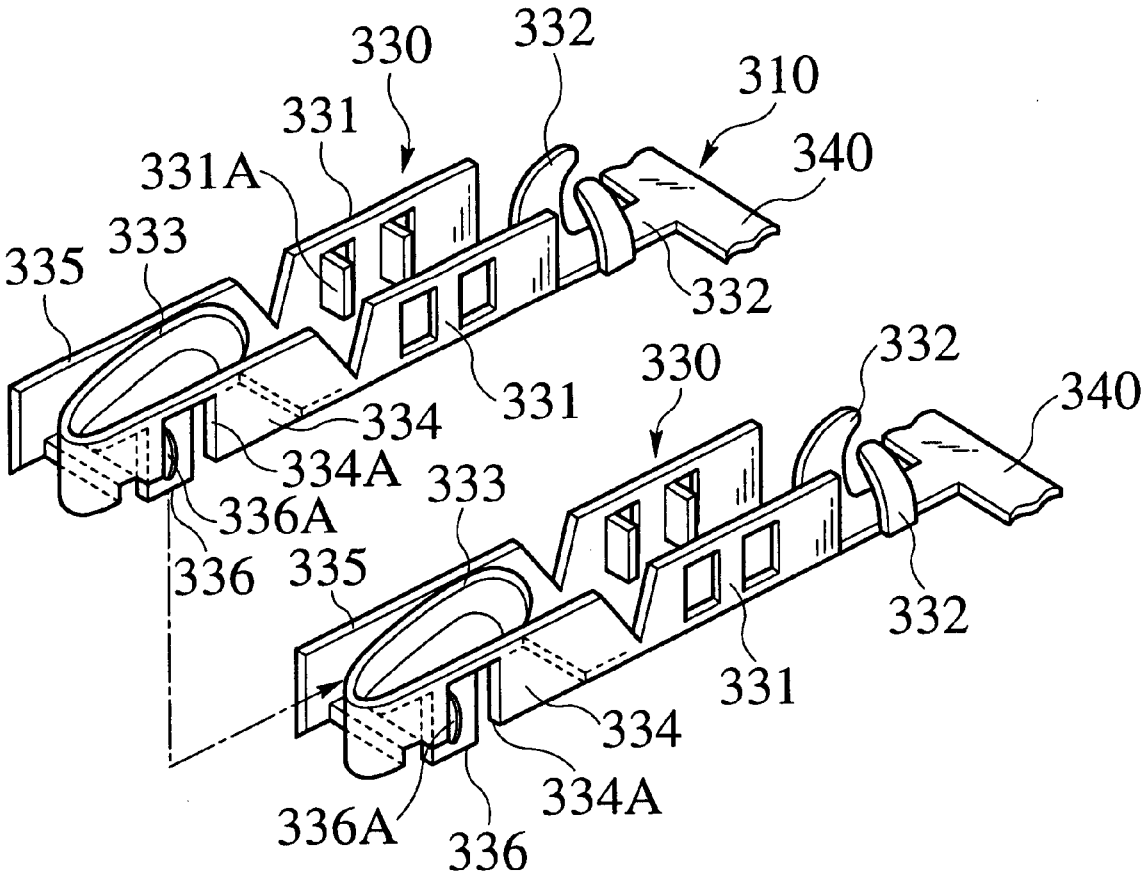
FIG. 24 is a perspective view illustrating a fourth embodiment of a joint connector of the invention.

As illustrated in FIG. 24, a linkage terminal 310 is provided by working or processing a metal plate. The linkage terminal 310 comprises a plurality of terminals 330 arranged in parallel and a carrier 340 connecting the terminals 330. The terminals 330 are connected in a multi-continuous manner via the career 340.

Figure 27:
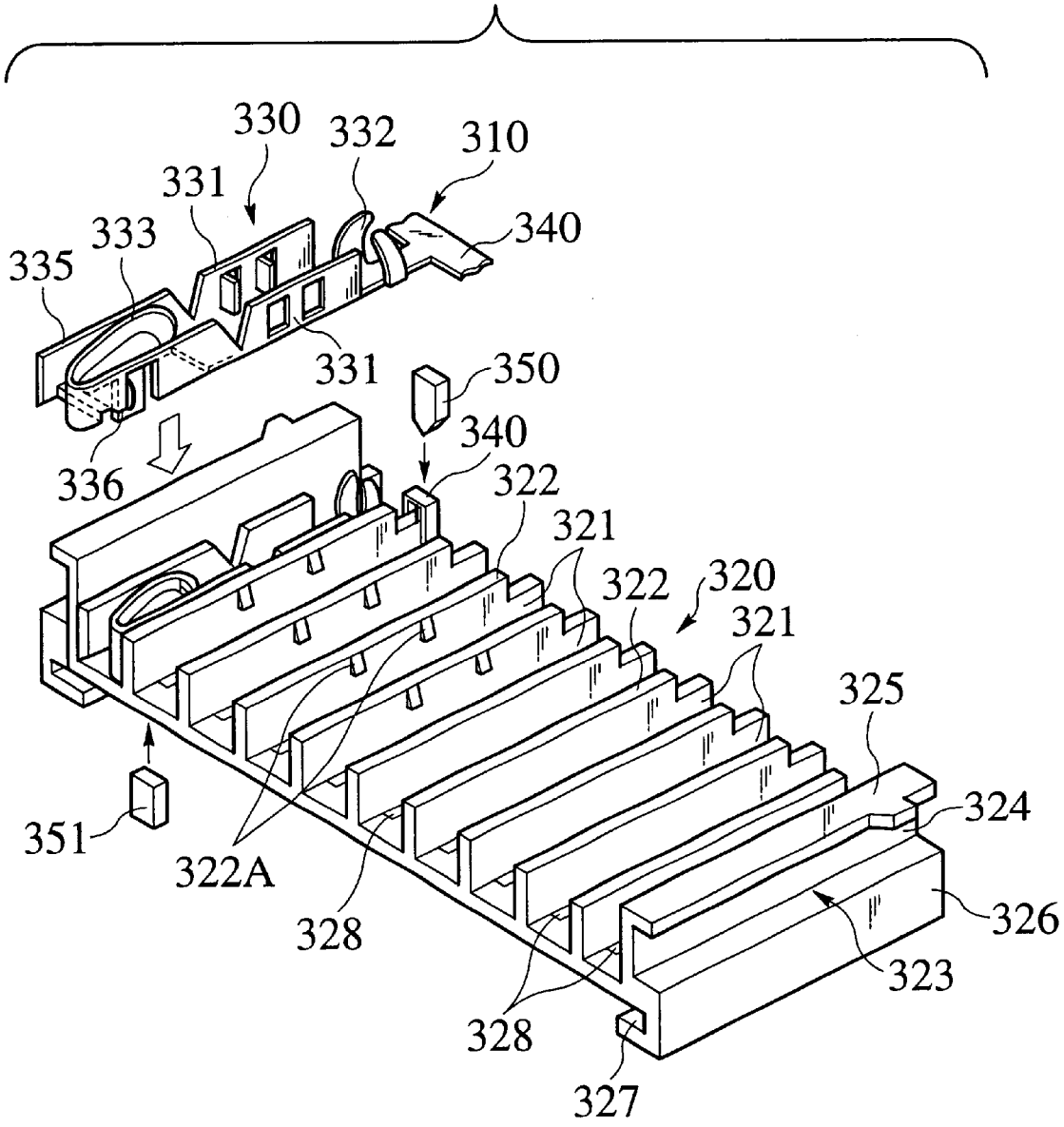
FIG. 27 is an exploded perspective view illustrating a module in the fourth embodiment.

As illustrated in FIG. 27, accommodation grooves 321 partitioned by partition walls 322 and arranged in parallel are formed in a housing 320 made of insulation resin material. Each accommodation groove 321 corresponds to each terminal 330 belonging to one linkage terminal 310.

Regarding a pair of parallel outside walls 323 of the housing 320, a slide groove 324 and a slide piece 325 are formed on an upper portion of each outside wall 323. A slid jetty 326 is formed at a lower portion of the outside wall 323. The slid jetty 326 is slidably received in a slide groove 324 of another housing 320. An inside slide groove 327 is formed inside the slide jetty 326. A slide piece 325 of still another housing 320 is slidably received in the inside slide groove 327.

A plugging-in hole 328 in which a connecting plugging-in piece 336 described later is inserted is formed in a bottom portion of each accommodation groove 321 positioned on a front end side. Engaging protrusions 322A for engagement of the terminal 330 are formed on an upper portion of each partition wall 322.

Figure 25:
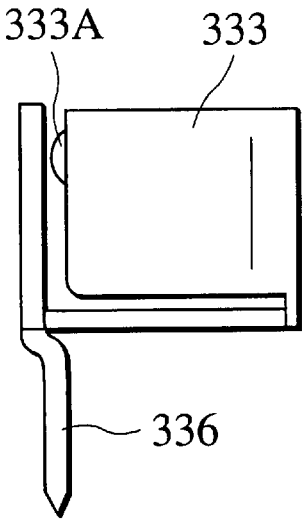
FIG. 25 is a front view illustrating a terminal in the fourth embodiment.

A pair of wire press-fitting plates 331, 331 erected from both side portions of the terminal 330 are disposed in an intermediate portion, in a longitudinal direction, of the terminal 330. Wire press-contacting pieces 331A, 331A are erected in a cut manner from the wire press-fitting plate 331. Bending pieces 332 erected from both side portions of the terminal 330 are formed at an intermediate portion between the wire press-fitting plates 331 and the carrier 340. A bent spring (wound spring) 333 serving as a portion to be connected such as illustrated in FIGS. 24 and 25 is formed at nearer to a distal end side than the wire press-fitting plates 331.

The bent spring 333 has a shape where a front end side of a standing side wall 334 of the terminal 330 is bent back rearward. A protrusion 333A is formed at a portion of the bent spring 333 contacting with the other standing side wall 335. A plugging-in piece 336 for connection serving as a connecting portion and projecting downward is formed at a lower portion of the other standing side wall 335 of the terminal 330. A slit 336A engaged with the protrusion 333A of the bent spring 333 is formed in the plugging-in piece 336.

A notch 334A is formed in the plugging-in piece 336 of the standing side wall 334. when the plugging-in piece 336 is not used for connection, the plugging-in piece 336 is bent to be accommodated in the notch 334A.

Figure 26:
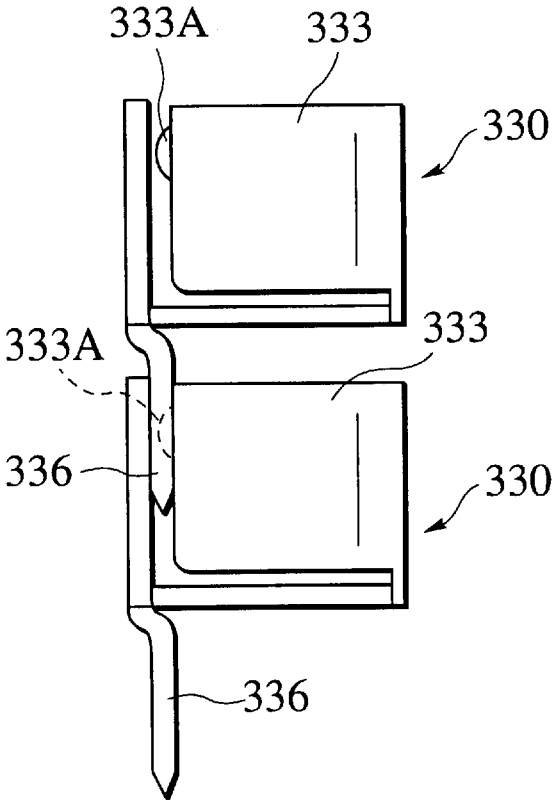
FIG. 26 is a front view illustrating a state where terminals have been connected to each other in the fourth embodiment.

In order to connect the terminals 330 thus structured to each other, the plugging-in piece 336 of the upper terminal 330 is slid on the lower terminal 330 from a front of the lower terminal 330 rearward, as illustrated in FIG. 24. Thereby, the connection of the terminals 330 is performed by plugging the plugging-in piece 336 in between the bent spring 333 and the standing side wall 335, as illustrated in FIG. 26.

At this time, the protrusion 333A of the bent spring 333 is fitted into the slit 336A of the plugging-in piece 336. FIG. 27 illustrates a state where the linkage terminal 310 is mounted in the housing 320. As illustrated in FIG. 27, the linkage terminal 310 cut out so as to include a predetermined number of the terminals 330 is mounted in the housing 320 and cutting off of the carrier 340 and/or bending of the plugging-in piece 336 for connection is performed according to a circuit configuration required. Reference numeral 350 in FIG. 27 is a cutting jig for cutting the carrier 340, and reference numeral 351 is a bending jig for bending the plugging-in piece 336 for connection.

Figure 28:
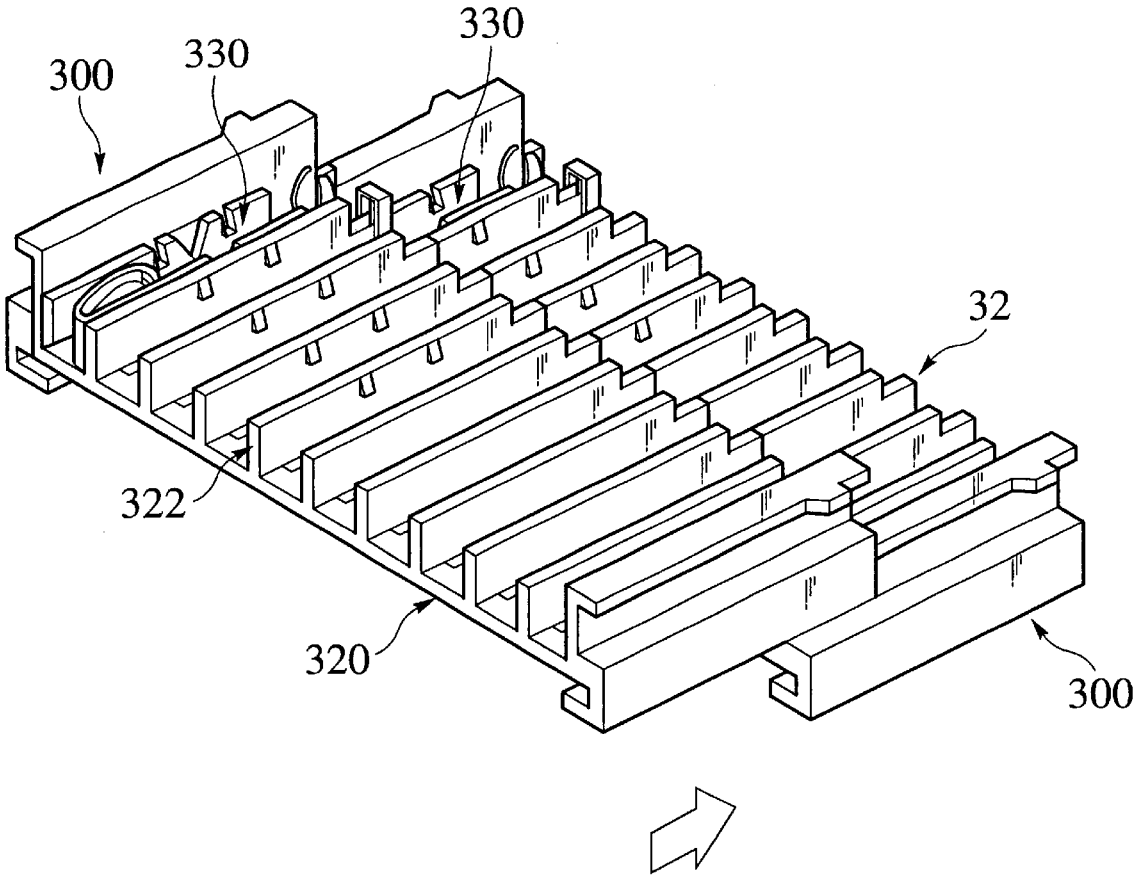
FIG. 28 is a perspective view illustrating how to assemble the modules in the fourth embodiment.

When a predetermined number of the modules 300 each having the housing 320 in which the linkage terminal 310 is mounted are stacked one on another for connection, the upper side module 300 is fitted and slid in the lower side module 300 from a front end side of the lower side module 300, as illustrated in FIG. 28.

According to such operations, the plugging-in piece 336 projecting downward from the housing 320 of the upper side module 300 is plugged in between the bent spring 333 and the standing side wall 335 of the terminal 330 of the lower side module 300 to be electrically connected to the terminal 330 of the lower side module 300.

In this embodiment, as illustrated in FIG. 28, connection of the upper side and lower side terminals 330 is performed by inserting the plugging-in piece 336 of the upper side terminal 330 moved from the front of the lower side terminal 330 rearward (in a direction indicated with a thick arrow in FIG. 28) to the bent spring 333 of the lower side terminal 330. Accordingly, the plugging-in piece 336 can be plugged in more securely than a method where a plugging-in piece is plugged in a vertical direction. In this embodiment, also, as a connection is performed in a sliding manner, no side wall is required at a front end of the housing 320 so that a housing structure can be made simple.

In the above, the respective embodiments have been explained, but the present invention is not limited to these embodiments. A various kinds of design modifications can be effected within the scope and the gist of the present invention. For example, in the first embodiment, the cover portion 24 formed with the insertion hole 24A in which the plugging-in piece 22 can be inserted is formed in the housing 22, but provision of the cover portion 24 is not required if the upper side and lower side terminals 13 can be connected substantially. Also, in the first embodiment, the linkage terminal 11 comprising the preliminarily multi-continuous terminals 13 has been prepared, but the present invention may be structured such that single terminals 13 are accommodated in the housing 12 and the terminals are connected to each other in a horizontal direction as required. Furthermore, in the above second embodiment, the linkage terminal 110 where the two linkage terminals 110A, 110B have been stacked and welded has been employed, but the present invention is not limited to this terminal 110.

What is claimed is:

1. A joint connector comprising:

upper lower housings capable of being stacked;

upper and lower linkage terminals respectively accommodated in the upper and lower housings, each linkage terminal including a plurality of conductive terminals integrally formed with the linkage terminal, each conductive terminal being connected with a wire and coupling portions between the conductive terminals, each conductive terminal including a portion to be connected and a connecting portion projecting from the portion to be connected, wherein the connecting portion extends beyond the respective housing when the linkage terminal is accommodated in its respective housing, wherein the connecting portion of a conductive terminal of the upper linkage terminal is connected to the portion to be connected of a conductive terminal of the lower linkage terminal when the housings are stacked in a predetermined position.

2. A joint connector according to claim 1, wherein the connecting portion is a connecting plate, and the portion to be connected holds the connecting portion resiliently.

3. A joint connector according to claim 1, wherein the housings mutually approach along a direction where the housings are stacked to reach the predetermined position, so that the connecting portion of a conductive terminal of the upper linkage terminal is connected with the portion to be connected of a conductive terminal of the lower linkage terminal.

4. A joint connector according to claim 1, wherein the housings mutually approach in a direction intersecting a direction where the housings are stacked to reach the predetermined position, so that the connecting portion of a conductive terminal of the upper linkage terminal is connected with the portion to be connected of a conductive terminal of the lower linkage terminal.

5. A joint connector according to claim 1, wherein each housing defines a plurality of first openings and second openings, the connecting portions of conductive terminals of one housing are respectively caused to pass through the first openings of the one housing, and the connecting portions of conductive terminals of the one housing are respectively caused to pass through the second openings of another housing.

6. A joint connector according to claim 5, wherein each housing has protection walls which are respectively at peripheral edges of the openings and which protect the connecting portions which are caused to pass through the openings.

7. A joint connector according to claim 1, further comprising engaging means for holding the housings in the predetermined position when the housings are stacked.

8. A joint connector according to claim 1, wherein each conductive terminal has a wire holding portion holding the wire.

9. A joint connector according to claim 1, wherein a portion to be connected can be deformed to prevent contact with its corresponding connecting portion when a connection between the portion to be connected and its corresponding connecting portion is not required.

10. A joint connector according to claim 1, wherein a connecting portion is cut out and removed when a connection between the connecting portion and its corresponding portion to be connected is not required.

11. A joint connector according to claim 1, wherein a coupling portion is cut so that the connection between conductive terminals that are adjacent is cut off when a connection between the adjacent conductive terminals is not required.

12. A joint connector according to claim 2 wherein the portion to be connected includes spring pieces which clamp the connecting plate.

* * * * *

UNITED STATES PATENT AND TRADEMARK OFFICE

CERTIFICATE OF CORRECTION

PATENT NO. : 6,319,071 B1
DATED : November 20, 2001
INVENTOR(S) : Kei Sato

It is certified that error appears in the above-identified patent and that said Letters Patent is hereby corrected as shown below:

Column 11,
Line 31, "upper lower" should read -- upper and lower --.

Signed and Sealed this

Seventh Day of May 2002

*Attest:*

*Attesting Officer*

JAMES E. ROGAN
*Director of the United States Patent and Trademark Office*